US007769584B2

(12) United States Patent
Oshikiri et al.

(10) Patent No.: US 7,769,584 B2
(45) Date of Patent: Aug. 3, 2010

(54) ENCODER, DECODER, ENCODING METHOD, AND DECODING METHOD

(75) Inventors: Masahiro Oshikiri, Kanagawa (JP); Hiroyuki Ehara, Kanagawa (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 714 days.

(21) Appl. No.: 11/718,452

(22) PCT Filed: Nov. 2, 2005

(86) PCT No.: PCT/JP2005/020200

§ 371 (c)(1),
(2), (4) Date: May 2, 2007

(87) PCT Pub. No.: WO2006/049204

PCT Pub. Date: May 11, 2006

(65) Prior Publication Data

US 2008/0052066 A1 Feb. 28, 2008

(30) Foreign Application Priority Data

Nov. 5, 2004 (JP) ..... 2004-322959

(51) Int. Cl.
*G10L 19/02* (2006.01)

(52) U.S. Cl. ..... 704/230; 704/222; 704/500

(58) Field of Classification Search ..... 704/205, 704/206, 220–223, 230, 500–504
See application file for complete search history.

(56) References Cited

U.S. PATENT DOCUMENTS 5,581,652 A * 12/1996 Abe et al. ..... 704/222
5,774,835 A * 6/1998 Ozawa ..... 704/205
6,611,800 B1 * 8/2003 Nishiguchi et al. ..... 704/221

(Continued)

FOREIGN PATENT DOCUMENTS

JP 2003-323199 11/2003

(Continued)

OTHER PUBLICATIONS

Miki Sukeichi, "Everything for MPEG-4", Kogyo Chosakai Publishing Inc., Sep. 30, 1998, pp. 126-127, along with a partial English language translation.

(Continued)

*Primary Examiner*—Abul Azad
(74) *Attorney, Agent, or Firm*—Greenblum & Bernstein, P.L.C.

(57) ABSTRACT

An encoder, decoder, encoding method, and decoding method enabling acquisition of high-quality decoded signal in scalable encoding of an original signal in first and second layers even if the second or upper layer section performs low bit-rate encoding. In the encoder, a spectrum residue shape codebook (305) stores candidates of spectrum residue shape vectors, a spectrum residue gain codebook (307) stores candidates of spectrum residue gains, and a spectrum residue shape vector and a spectrum residue gain are sequentially outputted from the candidates according to the instruction from a search section (306). A multiplier (308) multiplies a candidate of the spectrum residue shape vector by a candidate of the spectrum residue gain and outputs the result to a filtering section (303). The filtering section (303) performs filtering by using a pitch filter internal state set by a filter state setting section (302), a lag T outputted by a lag setting section (304), and a spectrum residue shape vector which has undergone gain adjustment.

10 Claims, 21 Drawing Sheets

U.S. PATENT DOCUMENTS

| | | | | |
|---|---|---|---|---|
| 2003/0088423 | A1* | 5/2003 | Nishio et al. | 704/500 |
| 2006/0251178 | A1* | 11/2006 | Oshikiri | 375/242 |

FOREIGN PATENT DOCUMENTS

| | | |
|---|---|---|
| JP | 2004-102186 | 4/2004 |
| JP | 2005-107255 | 4/2005 |

OTHER PUBLICATIONS

U.S. Appl. No. 11/577,816, to Oshikiri, which was filed on Apr. 24, 2007.

U.S. Appl. No. 11/718,437, to Ehara et al., which was filed on May 2, 2007.

English language abstract of JP 2003-323199.

English language abstract of JP 2004-102186.

English language abstract of JP 2005-107255.

Oshikiri et al., "A scalable coder designed for 10-KHz bandwidth speech," Speech Coding 2002, IEEE Workshop Proceedings, Oct. 6-9, 2002, Piscataway, NJ, USA, IEEE, Oct. 6, 2002, pp. 111-113, XP010647230.

* cited by examiner

ENCODER, DECODER, ENCODING METHOD, AND DECODING METHOD

TECHNICAL FIELD

The present invention relates to an encoding apparatus, decoding apparatus, encoding method and decoding method for encoding/decoding speech signals, audio signals, and the like.

BACKGROUND ART

In order to effectively utilize radio wave resources in mobile communication systems, it is required to compress speech signals at a low bit rate. On the other hand, it is expected from the user to improve quality of communication speech and implement communication services with high fidelity. In order to implement this, it is preferable not only to improve quality of speech signals, but also to be capable of encoding signals other than speech, such as audio signals having a wider band with high quality.

For such contradictory demands, an approach of hierarchically incorporating a plurality of coding techniques shows promise. Specifically, a configuration is adopted combining in a layered way a first layer encoding section that encodes an input signal using a low bit rate using a model suitable for a speech signal and a second layer encoding section that encodes a residual signal between the input signal and the first layer decoded signal using a model suitable for common signals including the speech signal. Coding schemes having such a layered structure have scalability (capable of obtaining decoded signals even from partial information of bit streams) in bit streams obtained by an encoding section, and such schemes are therefore referred to as scalable coding. The scalable coding has a feature of being capable of also flexibly supporting communication between networks having different bit rates. This feature is suitable for a future network environment where a variety of networks will be integrated with IP protocol.

As conventional scalable coding, for example, there is scalable coding disclosed in Non-Patent Document 1. This document discloses a method where scalable coding is configured using the technique defined in MPEG-4 (Moving Picture Experts Group phase-4). Specifically, at a first layer (base layer), a speech signal—original signal—is encoded using CELP (Code Excited Linear Prediction), and at a second layer (extension layer), a residual signal is encoded using transform coding such as, for example, ACC (Advanced Audio Coder) and TwinVQ (Transform Domain Weighted Interleave Vector Quantization). Here, the residual signal is a signal obtained by subtracting a signal (first layer decoded signal) which is obtained by decoding the encoded code obtained at the first layer, from the original signal.

Non-patent document 1: "Everything for MPEG-4", written by Miki Sukeichi, published by Kogyo Chosakai Publishing, Inc., Sep. 30, 1998, pages 126 to 127

DISCLOSURE OF INVENTION

Problems to be Solved by the Invention

However, with the technique of the related art described above, transform coding at the second layer is carried out on the residual signal obtained by subtracting the first layer decoded signal from the original signal. As a result, part of the main information contained in the original signal is removed via the first layer. In this case, the characteristic of the residual signal is close to a noise sequence. Therefore, when transform coding designed so as to efficiently encode music signals such as AAC and TwinVQ is used for the second layer, in order to encode a residual signal having the above-described characteristic and achieve high quality of the decoded signal, it is necessary to allocate a large number of bits. This means that the bit rate becomes large.

It is therefore an object of the present invention taking into consideration these problems to provide an encoding apparatus, decoding apparatus, encoding method and decoding method capable of obtaining high-quality decoded signals even when encoding is carried out at a low bit rate at the second layer or upper layers than the second layer.

Means for Solving the Problem

An encoding apparatus of the present invention generates low-frequency-band encoding information and high-frequency-band encoding information from an original signal and adopts a configuration including: a first spectrum calculating section that calculates a first spectrum of a low frequency band from a decoded signal of the low-frequency-band encoding information; a second spectrum calculating section that calculates a second spectrum from the original signal; a first parameter calculating section that calculates a first parameter indicating a degree of similarity between the first spectrum and a high frequency band of the second spectrum; a second parameter calculating section that calculates a second parameter indicating a fluctuation component between the first spectrum and the high frequency band of the second spectrum; and an encoding section that encodes the calculated first parameter and second parameter as the high-frequency-band encoding information.

The encoding apparatus of the present invention generates low-frequency-band encoding information and high-frequency-band encoding information from an original signal and adopts a configuration including: a first spectrum calculating section that calculates a first spectrum of a low frequency band from a decoded signal of the low-frequency-band encoding information; a second spectrum calculating section that calculates a second spectrum from the original signal; a parameter calculating section that calculates a parameter indicating a degree of similarity between the first spectrum and a high frequency band of the second spectrum; a parameter encoding section that encodes the calculated parameter as the high-frequency-band encoding information; and a residual component encoding section that encodes a residual component between the first spectrum and a low frequency band of the second spectrum, wherein the parameter calculating section calculates the parameter after improving quality of the first spectrum using the residual component encoded by the residual component encoding section.

A decoding apparatus of the present invention adopts a configuration including: a spectrum acquiring section that acquires a first spectrum corresponding to a low frequency band; a parameter acquiring section that respectively acquires a first parameter that is encoded as high-frequency-band encoding information and indicates a degree of similarity between the first spectrum and a high frequency band of a second spectrum corresponding to an original signal, and a second parameter that is encoded as high-frequency-band encoding information and indicates a fluctuation component between the first spectrum and the high frequency band of the second spectrum; and a decoding section that decodes the second spectrum using the acquired first parameter and second parameter.

An encoding method of the present invention for generating low-frequency-band encoding information and high-frequency-band encoding information based on an original signal, adopts a configuration including: a first spectrum calculating step of calculating a first spectrum of a low frequency band from a decoded signal of the low-frequency-band encoding information; a second spectrum calculating step of calculating a second spectrum from the original signal; a first parameter calculating step of calculating a first parameter indicating a degree of similarity between the first spectrum and a high frequency band of the second spectrum; a second parameter calculating step of calculating a second parameter indicating a fluctuation component between the first spectrum and the high frequency band; and an encoding step of encoding the calculated first parameter and second parameter as the high-frequency-band encoding information.

A decoding method of the present invention adopts a configuration including: a spectrum acquiring step of acquiring a first spectrum corresponding to a low frequency band; a parameter acquiring step of respectively acquiring a first parameter that is encoded as high-frequency-band encoding information and indicates a degree of similarity between the first spectrum and a high frequency band of a second spectrum corresponding to an original signal, and a second parameter that is encoded as high-frequency-band encoding information and indicates a fluctuation component between the first spectrum and the high frequency band of the second spectrum; and a decoding step of decoding the second spectrum using the acquired first parameter and second parameter.

Advantageous Effect of the Invention

According to the present invention, it is possible to obtain a high-quality decoded signal by carrying out encoding at a low bit rate at the second layer or upper layers than the second layer.

BEST MODE FOR CARRYING OUT THE INVENTION

The present invention relates to transform coding suitable for enhancement layers in scalable coding, and, more particularly, a method of efficient spectrum coding in the transform coding.

One main characteristic is that filtering processing is carried out using a filter taking a spectrum (first layer decoded spectrum) obtained by performing frequency analysis on a first layer decoded signal as an internal state (filter state), and this output signal is taken as an estimated value for a high frequency band of an original spectrum. Here, the original spectrum is a spectrum obtained by performing frequency analysis on a delay-adjusted original signal. Filter information, when the generated output signal is most analogous at the high frequency band of the original spectrum, is encoded and transmitted to a decoding section. It is only necessary to encode the filter information, and therefore it is possible to achieve a low bit rate.

In one embodiment of the present invention, filtering processing is carried out with a spectrum residual provided to the filter, using a spectrum residual shape codebook recorded with a plurality of spectrum residual candidates. In a further embodiment, an error component of a first layer decoded spectrum is encoded before a first layer decoded spectrum is stored as an internal state of the filter, and after quality of the first layer decoded spectrum is improved, a high frequency band of the original spectrum is estimated by filtering processing. Moreover, in a still further embodiment, an error component of a first layer decoded spectrum is encoded so that both first layer decoded spectrum encoding performance and high-frequency-band spectrum estimation performance using the first layer decoded spectrum become high upon encoding the error component of the first layer decoded spectrum.

Embodiments of the present invention will be described in detail with reference to the accompanying drawings. In each of the embodiments, scalable coding having a layered structure made up of a plurality of layers is carried out. Further, in each embodiment, as an example, it is taken that (1) a layered structure of scalable coding is two layers of a first layer (base layer or lower layer) and a second layer which is upper layer than the first layer (extension layer or enhancement layer), (2) encoding (transform coding) is carried out in a frequency domain in encoding of the second layer, (3) MDCT (Modified Discrete Cosine Transform) is used as the transform scheme in encoding of the second layer, (4) in encoding of the second layer, when the whole band is divided into a plurality of subbands, the whole band is divided at regular intervals using a Bark scale, and each subband then corresponds to each critical band, and (5) the relationship that F2 is greater than or equal to F1 (F1≦F2) holds between a sampling rate (F1) of an input signal for the first layer and a sampling rate (F2) of an input signal for the second layer.

Embodiment 1

Figure 1:
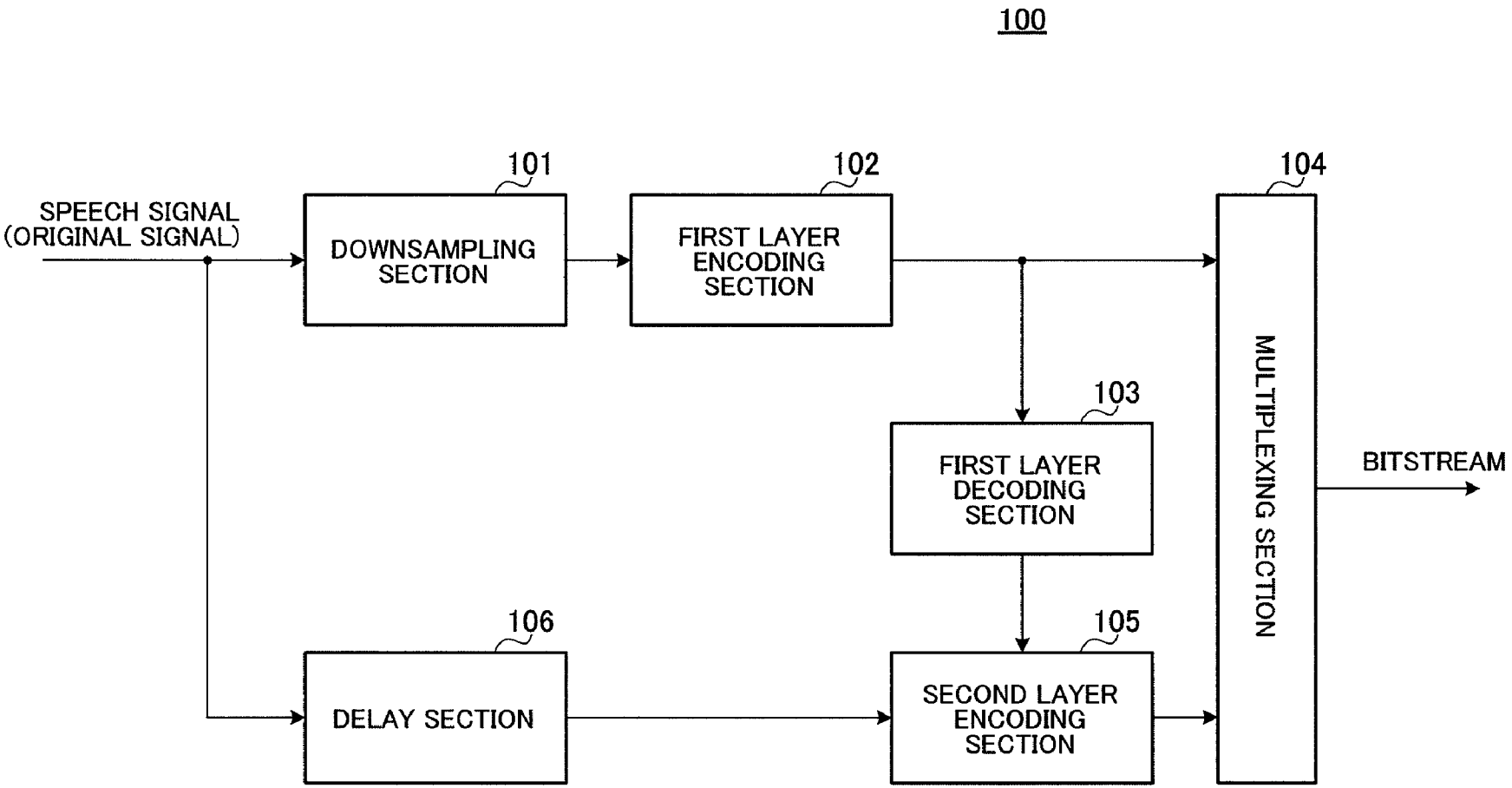
FIG. 1 is a block diagram showing a configuration of an encoding apparatus according to Embodiment 1 of the present invention.

FIG. 1 is a block diagram showing a configuration of encoding apparatus 100 configuring, for example, a speech encoding apparatus. Encoding apparatus 100 has downsampling section 101, first layer encoding section 102, first layer decoding section 103, multiplexing section 104, second layer encoding section 105 and delay section 106.

In FIG. 1, a speech signal and audio signal (original signal) of a sampling rate of F2 are supplied to downsampling section 101, sampling transform processing is carried out at downsampling section 101, and a signal of sampling rate of F1 is generated and supplied to first layer encoding section 102. First layer encoding section 102 then outputs the encoded code obtained by encoding the signal of sampling rate of F1 to first layer decoding section 103 and multiplexing section 104.

First layer decoding section 103 then generates a first layer decoded signal from the encoded code outputted from first layer encoding section 102 and outputs the first layer decoded signal to second layer encoding section 105.

Delay section 106 gives a delay of a predetermined length to the original signal and outputs the result to second layer encoding section 105. This delay is for adjusting a time delay occurring at downsampling section 101, first layer encoding section 102 and first layer decoding section 103.

Second layer encoding section 105 encodes the original signal outputted from delay section 106 using the first layer decoded signal outputted from first layer decoding section 103. The encoded code obtained as a result of this encoding is then outputted to multiplexing section 104.

Multiplexing section 104 then multiplexes the encoded code outputted from first layer encoding section 102 and the encoded code outputted from second layer encoding section 105, and outputs the result as a bitstream.

Figure 2:
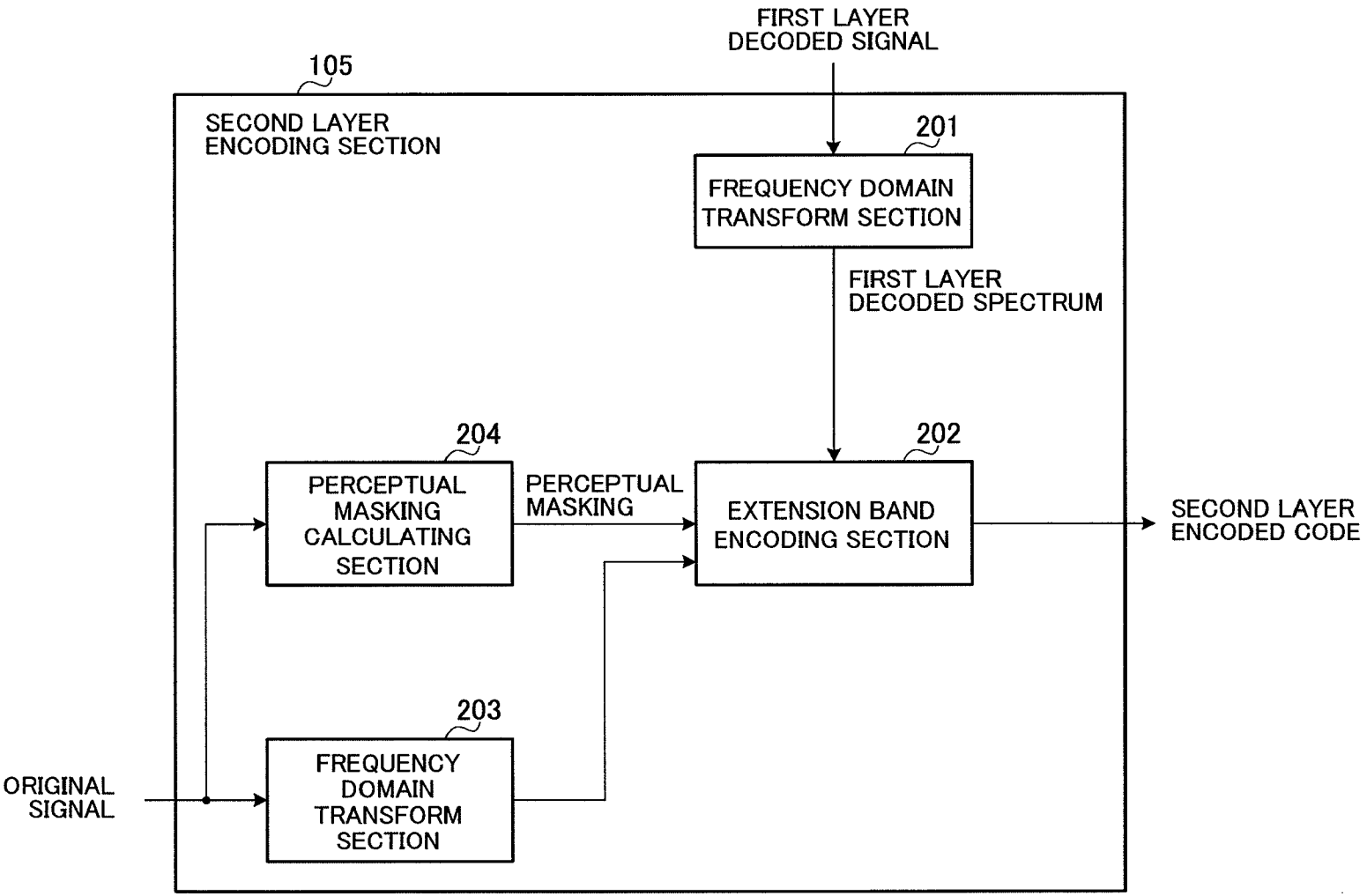
FIG. 2 is a block diagram showing a configuration of a second layer encoding section according to Embodiment 1 of the present invention.

Next, second layer encoding section 105 will be described in more detail. A configuration of second layer encoding section 105 is shown in FIG. 2. Second layer encoding section 105 has frequency domain transform section 201, extension band encoding section 202, frequency domain transform section 203 and perceptual masking calculating section 204.

In FIG. 2, frequency domain transform section 201 performs frequency analysis on the first layer decoded signal outputted from first layer decoding section 103 so as to calculate MDCT coefficients (first layer decoded spectrum). The first layer decoded spectrum is then outputted to extension band encoding section 202.

Frequency domain transform section 203 calculates MDCT coefficients (original spectrum) by frequency-analyzing the original signal outputted from delay section 106 using MDCT transformation. The original spectrum is then outputted to extension band encoding section 202.

Perceptual masking calculating section 204 then calculates perceptual masking for each band using the original signal outputted from delay section 106 and reports this perceptual masking to extension band encoding section 202.

Here, human perceptual perception has perceptual masking characteristics that, when a given signal is being heard, even if sound having a frequency close to that signal comes to the ear, the sound is difficult to be heard. The perceptual masking is used in order to implement efficient spectrum coding. In this spectrum coding, quantization distortion which is permitted from an perceptual point of view is quantified using the perceptual masking characteristics of human, and the encoding method according to the permitted quantization distortion is applied.

Figure 3:
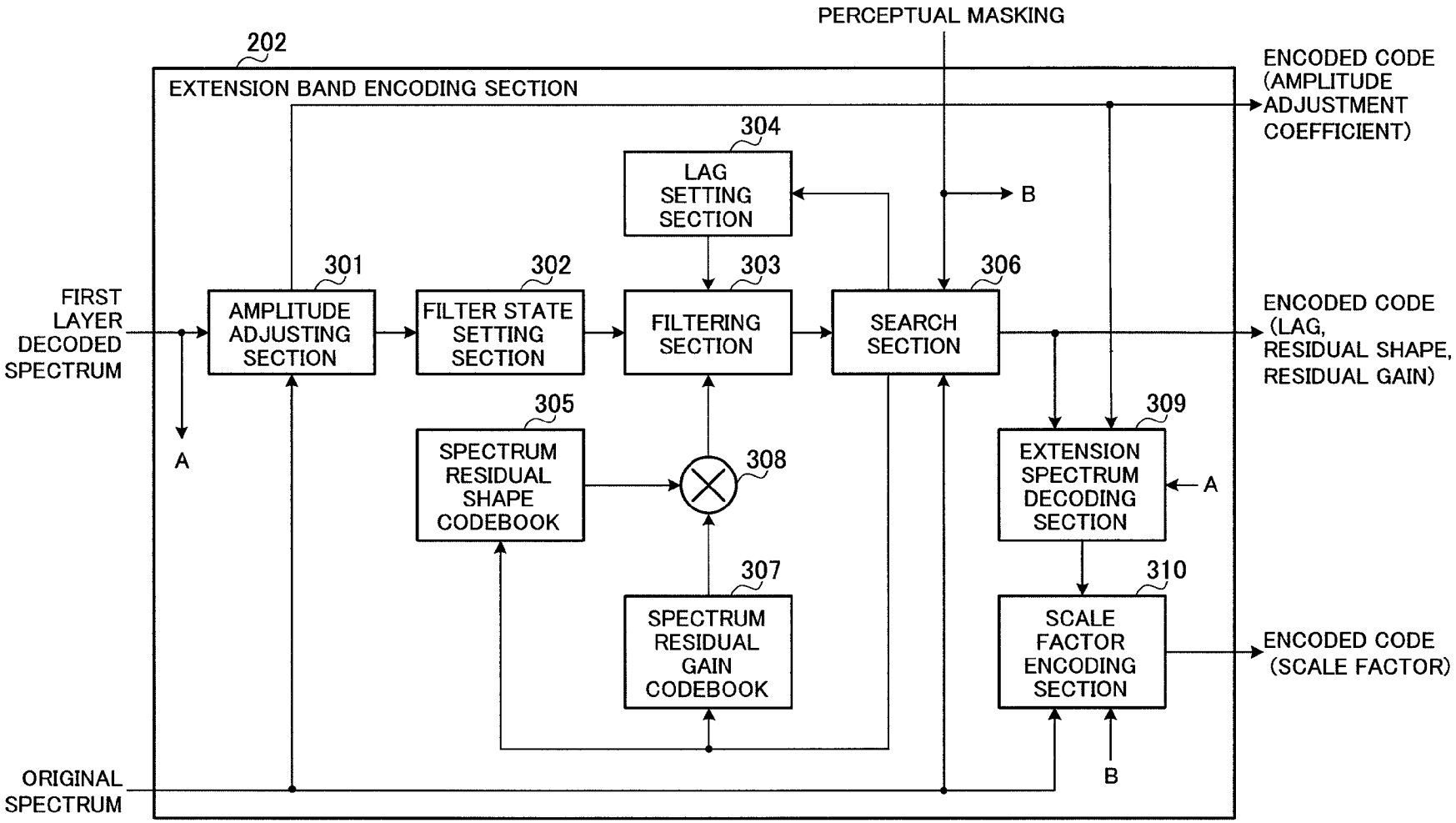
FIG. 3 is a block diagram showing a configuration of an extension band encoding section according to Embodiment 1 of the present invention.

As shown in FIG. 3, extension band encoding section 202 has amplitude adjusting section 301, filter state setting section 302, filtering section 303, lag setting section 304, spectrum residual shape codebook 305, search section 306, spectrum residual gain codebook 307, multiplier 308, extension spectrum decoding section 309 and scale factor encoding section 310.

First layer decoded spectrum {S1(k); 0≦k<Nn} from frequency domain transform section 201 and original spectrum {S2(k); 0≦k<Nw} from frequency domain transform section 203 are supplied to amplitude adjusting section 301. Here, a relationship Nn<Nw holds when a number of spectrum point for the first layer decoded spectrum is expressed as Nn, and a number of spectrum point for the original spectrum is expressed as Nw.

Amplitude adjusting section 301 adjusts amplitude so that the ratio (dynamic range) between the maximum amplitude spectrum of the first layer decoded spectrum {S1(k); 0≦k<Nn} and the minimum amplitude spectrum approaches the dynamic range of high frequency band of the original spectrum {S2(k); 0≦k<Nw}. Specifically, as shown in the following equation 1, the power of the amplitude spectrum is taken.

$$S1'(k)=\mathrm{sign}(S1(k))\cdot|S1(k)|^{\gamma} \quad \text{(Equation 1)}$$

Here, sign( ) is a function returning a positive sign/negative sign, and γ is a real number in the range of 0≦γ≦1. Amplitude adjusting section 301 selects γ (amplitude adjustment coefficient) for when the dynamic range of the amplitude-adjusted first layer decoded spectrum is closest to the dynamic range of high frequency band of the original spectrum {S2(k); 0≦k<Nw} from a plurality of candidates prepared in advance, and outputs the encoded code to multiplexing section 104.

Filter state setting section 302 sets the amplitude-adjusted first layer decoded spectrum {S1'(k); 0≦k<Nn} as the internal state of a pitch filter described in the following. Specifically, the amplitude-adjusted first layer decoded spectrum {S1(k); 0≦k<Nn} is allocated in spectrum generation buffer {S(k); 0≦k<Nn}, and is outputted to filtering section 303.

Here, spectrum generation buffer S(k) is an array variable defined in the range of 0≦k<Nw. Candidates for an estimated value of the original spectrum (hereinafter referred to as "estimated original spectrum") at point (Nw-Nn) are generated using filtering processing described in the following.

Lag setting section 304 sequentially outputs lag T to filtering section 303 while gradually changing lag T within a search range of TMIN to TMAX set in advance in accordance with an instruction from search section 306.

Spectrum residual shape codebook 305 stores a plurality of spectrum residual shape vector candidates. Further, spectrum residual shape vectors are sequentially outputted from all candidates or from within candidates limited in advance, in accordance with the instruction from search section 306.

Similarly, spectrum residual gain codebook 307 stores a plurality of spectrum residual gain candidates. Further, spectrum residual gains are sequentially outputted from all candidates or from within candidates limited in advance, in accordance with the instruction from search section 306.

Multiplier 308 then multiplies the spectrum residual shape vectors outputted from spectrum residual shape codebook 305 and the spectrum residual gain outputted from spectrum residual gain codebook 307 and adjusts gain of the spectrum residual shape vectors. The gain-adjusted spectrum residual shape vectors are then outputted to filtering section 303.

Filtering section 303 then carries out filtering processing using the internal state of the pitch filter set at filter state setting section 302, lag T outputted from lag setting section 304, and gain-adjusted spectrum residual shape vectors, and calculates an estimated original spectrum. A pitch filter transfer function can be expressed by the following equation 2. Further, this filtering processing can be expressed by the following equation 3.

$$P(z) = \frac{1}{1 - z^{-T}} \quad \text{(Equation 2)}$$

$$S(k)=S(k-T)+g(j)\cdot C(i,k)\ Nn\leqq k<Nw \quad \text{(Equation 3)}$$

Figure 4:
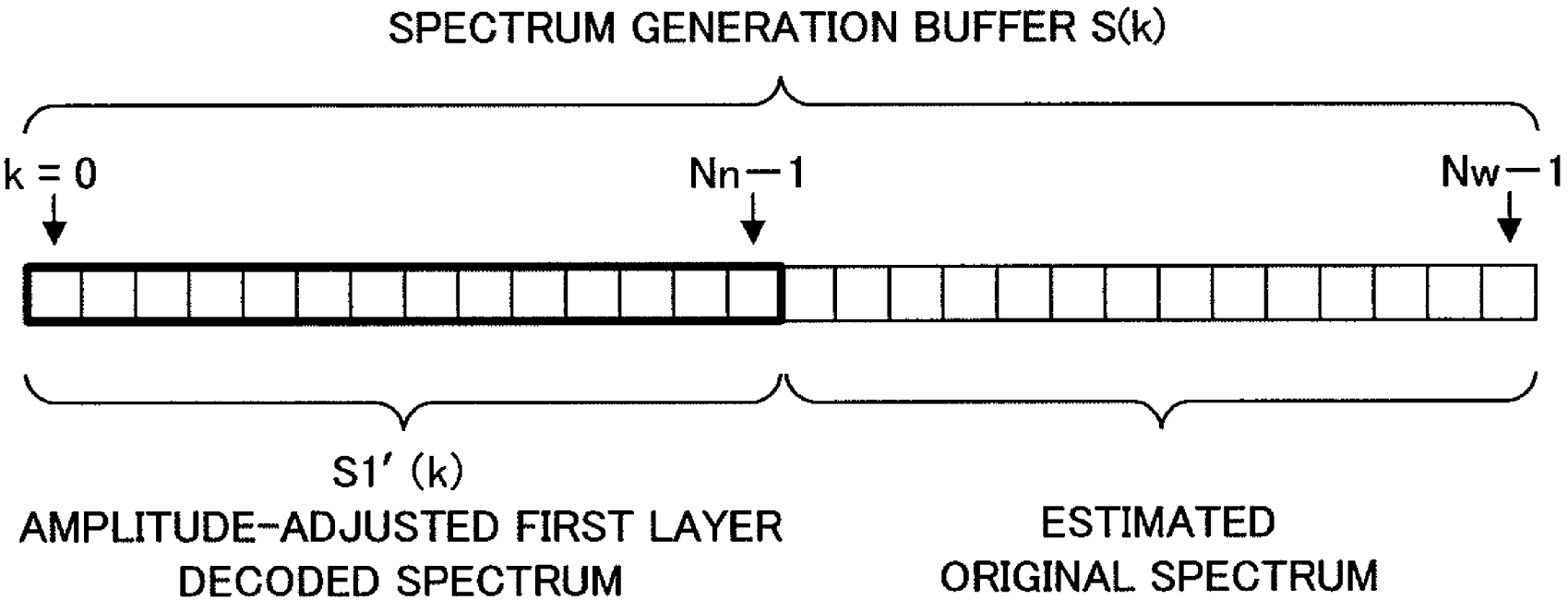
FIG. 4 is a schematic diagram showing a spectrum generation buffer processed at a filtering section of the extension band encoding section according to Embodiment 1 of the present invention.

Here, C(i, k) is the i-th spectrum residual shape vector, and g(j) is the j-th residual shape gain. Spectrum generation buffer S(k) contained in the range of Nn≦k<Nw is outputted to search section 306 as an output signal (that is, estimated original spectrum) of filtering section 303. The correlation between the spectrum generation buffer, the amplitude-adjusted first layer decoded spectrum and output signal of filtering section 303 is shown in FIG. 4.

Search section 306 instructs lag setting section 304, spectrum residual shape codebook 305 and spectrum residual gain codebook 307 to output lag, spectrum residual shape and spectrum residual gain, respectively.

Further, search section 306 calculates distortion E between high frequency band of the original spectrum {S2(k); Nn≦k<Nw} and output signal of filtering section 303 {S(k); Nn≦k<Nw}. A combination of lag, spectrum residual shape vector and spectrum residual gain for when the distortion is a minimum is then decided using AbS (Analysis by Synthesis). At this time, a combination whose perceptual distortion is a minimum is selected utilizing perceptual masking outputted from perceptual masking calculating section 204. When this distortion is taken to be E, distortion E is expressed by equation 4 using weighting coefficient w(k) decided using, for example, perceptual masking. Here, weighting coefficient w(k) becomes a small value at a frequency where perceptual masking is substantial (distortion is difficult to hear) and becomes a large value at a frequency where perceptual masking is small (distortion is easy to hear).

$$E = \sum_{k=Nn}^{Nw-1} w(k)\cdot(S2(k) - S(k))^2 \quad \text{(Equation 4)}$$

An encoded code for lag decided by search section 306, an encoded code for spectrum residual shape vectors, and an encoded code for spectrum residual gain are outputted to multiplexing section 104 and extension spectrum decoding section 309.

In the above-described method for deciding an encoded code using AbS, it is possible to decide a spectrum residual shape vector and spectrum residual gain at the same time, or to sequentially decide each parameter (for example, in the order of a lag, spectrum residual shape vector and spectrum residual gain) in order to reduce the amount of calculation.

Extension spectrum decoding section 309 decodes the encoded code for lag outputted from search section 306 together with the encoded code for an amplitude adjustment coefficient, the encoded code for spectrum residual shape vectors and the encoded code for spectrum residual gain outputted from amplitude adjusting section 301, and generates an estimated value for the original spectrum (estimated original spectrum).

Specifically, first, amplitude adjustment of first layer decoded spectrum {S1(k); 0≦k<Nn} is carried out in accordance with the above-described equation 1 using the decoded amplitude adjustment coefficient γ. Next, the amplitude-adjusted first layer decoded spectrum is used as an internal state of the filter, filtering processing is carried out in accordance with the above-described equation 3 using a decoded lag, spectrum residual shape vector and spectrum residual gain, and estimated original spectrum {S(k); Nn≦k<Nw} is generated. The generated estimated original spectrum is then outputted to scale factor encoding section 310.

Scale factor encoding section 310 then encodes the scale factor (scaling coefficients) of the estimated original spectrum that is most suitable from an perceptual point of view utilizing perceptual masking using high frequency band of the original spectrum {S2(k); Nn≦k<Nw} outputted from frequency domain transform section 203 and estimated original spectrum {S(k); Nn≦k<Nw} outputted from extension spectrum decoding section 309, and outputs the encoded code to multiplexing section 104.

Namely, the second layer encoded code is comprised of a combination of the encoded code (amplitude adjustment coefficient) outputted from amplitude adjusting section 301, the encoded code (lag, spectrum residual shape vector, spectrum residual gain) outputted from search section 306, and the encoded code (scale factor) outputted from scale factor encoding section 310.

In this embodiment, a configuration has been described where one set of encoded codes (amplitude adjustment coefficient, lag, spectrum residual shape vector, spectrum residual gain and scale factor) is decided by applying extension band encoding section 202 to bands Nn to Nw, but a configuration is also possible where bands Nn to Nw are divided into a plurality of bands, and extension band encoding section 202 is applied to each band. In this case, the encoded codes (amplitude adjustment coefficient, lag, spectrum residual vector, spectrum residual gain and scale factor) are decided for each band and outputted to multiplexing section 104. For example, when bands Nn to Nw are divided into M bands, and extension band encoding section 202 is applied to each band, M sets of encoded codes (amplitude adjustment coefficient, lag, spectrum residual shape vector, spectrum residual gain and scale factor) are then obtained.

Further, it is also possible to share parts of encoded codes between neighboring bands without transmitting encoded codes independently for a plurality of bands. For example, when bands Nn to Nw are divided into M bands and an amplitude adjustment coefficient common to the neighboring bands are used, the number of encoded codes for amplitude adjustment coefficients becomes M/2, and the number of encoded codes for other than this becomes M.

In this embodiment, the case has been described where a one order AR type pitch filter is used. However, filters to which the present invention can be applied are by no means limited to a one order AR type pitch filter, and the present invention can also be applied to a filter with a transfer function that can be expressed using the following equation 5. It is possible to express a wider variety of characteristics and improve quality using a pitch filter with larger parameters L and M defining a filter order. However, it is necessary to allocate a large number of encoding bits for filter coefficients in accordance with an increase in the order, and it is therefore necessary to decide a transfer function of an appropriate pitch filter based on practical bit allocation.

$$P(z) = \frac{1 + \sum_{j=-M}^{M} \gamma_j z^{-T-j}}{1 - \sum_{i=-L}^{L} \beta_i z^{-T+i}} \quad \text{(Equation 5)}$$

In this embodiment, it is assumed that perceptual masking is used, but a configuration where perceptual masking is not used is also possible. In this case, it is no longer necessary to provide perceptual masking calculating section 204 in FIG. 2 at second layer encoding section 105, so that the amount of calculation for the overall apparatus can be reduced.

Figure 5:
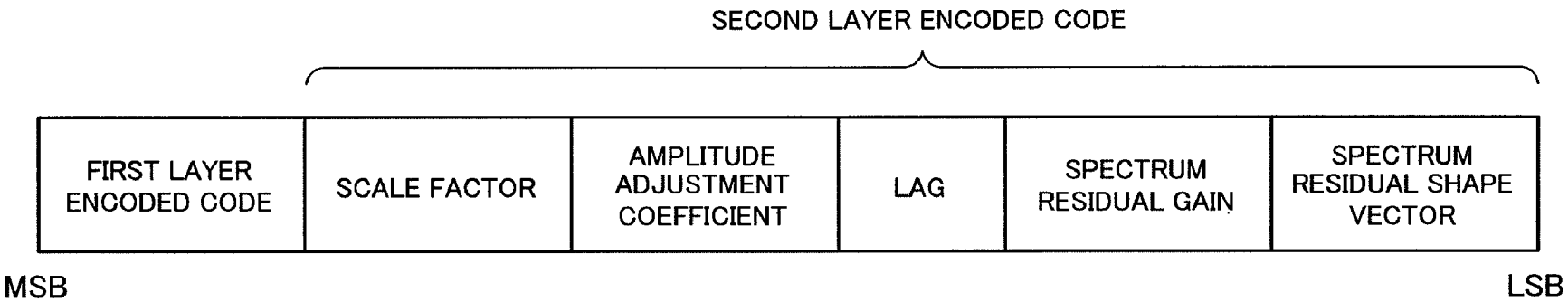
FIG. 5 is a schematic diagram showing the content of a bitstream outputted from a multiplexing section of the encoding apparatus according to Embodiment 1 of the present invention.

Here, a configuration of the bitstream outputted from multiplexing section 104 will be described using FIG. 5. A first layer encoded code and a second layer encoded code are stored in order from the MSB (Most Significant Bit) of the bitstream. Further, the second layer encoded code is stored in order of scale factor, amplitude adjustment coefficient, lag, spectrum residual gain and spectrum residual shape vector, and information for the latter is arranged at positions closer to the LSB (Least Significant Bit). The configuration of this bitstream is such that, with respect to sensitivity to code loss of each encoded code (the extent to which quality of a decoded signal is made deteriorate when encoded code is lost), parts of the bitstream where sensitivity to coding errors is higher (large deterioration) are arranged at positions closer to the MSB. According to this configuration, it is possible to minimize deterioration due to discarding by discarding in order from the LSB when the bitstream is partially discarded on the transmission channel. In an example of a network configuration where a bitstream is discarded in order of priority from the LSB, each encoded code divided into sections as shown in FIG. 5 is transmitted using separate packets, priority is assigned to each packet, and a packet network capable of priority control is used. The network configuration is by no means limited to that described above.

Further, in a bitstream configuration where coded parameters with a higher coding error sensitivity as shown in FIG. 5 are arranged at positions closer to the MSB, by applying channel encoding so that error detection and error correction is applied in a more rigorous manner to bits closer to the MSB, it is possible to minimize deterioration in decoding quality. For example, CRC coding and RS coding may be applied as methods for error detection and error correction.

Figure 6:
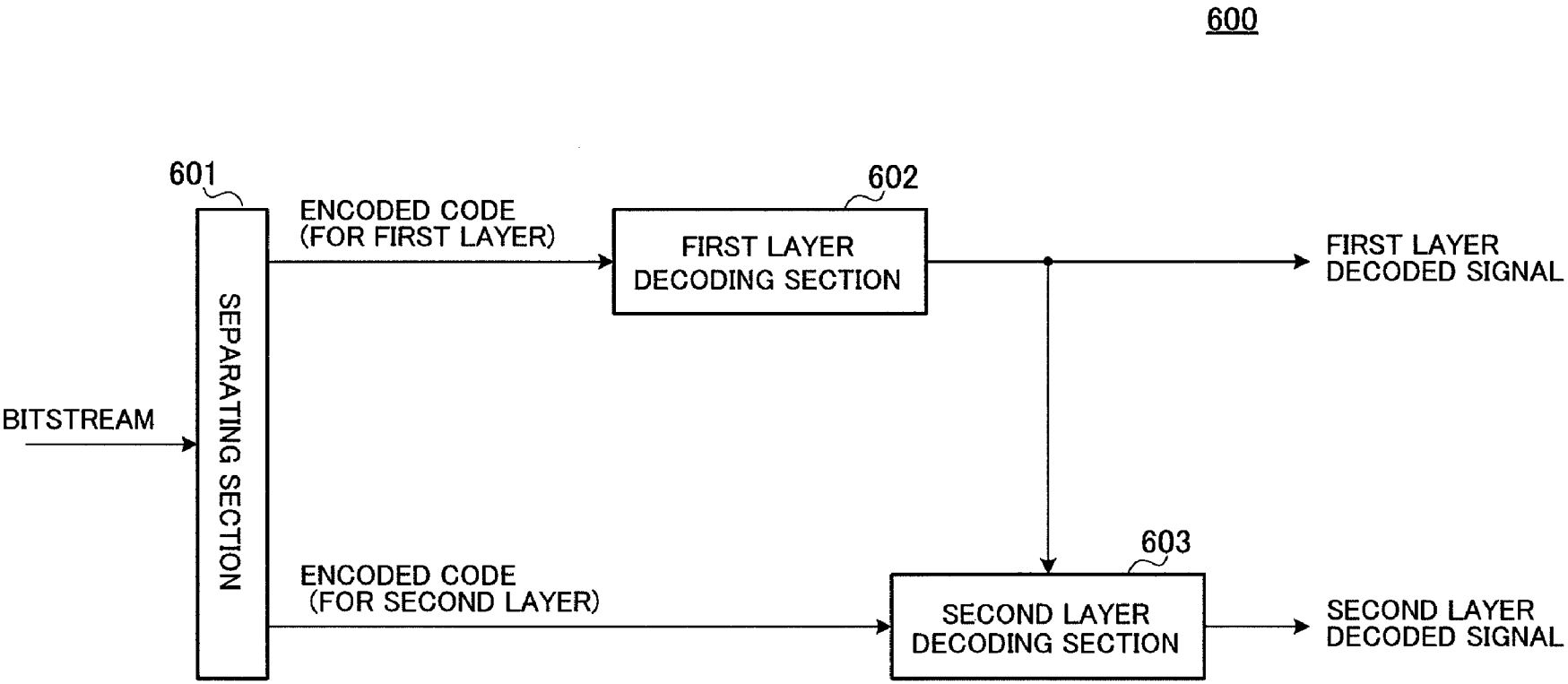
FIG. 6 is a block diagram showing a configuration of a decoding apparatus according to Embodiment 1 of the present invention.

FIG. 6 is a block diagram showing a configuration of decoding apparatus 600 configuring, for example, a speech decoding apparatus.

Decoding apparatus 600 is configured with separating section 601 that separates a bitstream outputted from encoding apparatus 100 into a first layer encoded code and a second layer encoded code, first layer decoding section 602 that decodes the first layer encoded code, and second layer decoding section 603 that decodes the second layer encoded code.

Separating section 601 receives the bitstream transmitted from encoding apparatus 100, separates the bitstream into the first layer encoded code and the second layer encoded code, and outputs the results to first layer decoding section 602 and second layer decoding section 603.

First layer decoding section 602 then generates a first layer decoded signal from the first layer encoded code and outputs the signal to second layer decoding section 603. Further, the generated first layer decoded signal is then outputted as a decoded signal (first layer decoded signal) ensuring minimum quality as necessary.

Second layer decoding section 603 then generates a high-quality decoded signal (referred to here as "second layer decoded signal") using the first layer decoded signal and the second layer encoded code and outputs this decoded signal as necessary.

In this way, minimum quality for reproduced speech is ensured using the first layer decoded signal, and quality of reproduced speech can be improved using the second layer decoded signal. Further, which of the first layer decoded signal and the second layer decoded signal is adopted as the output signal depends on whether or not the second layer encoded code can be obtained according to the network environment (such as occurrence of packet loss) and depends on the application and user settings.

Figure 7:
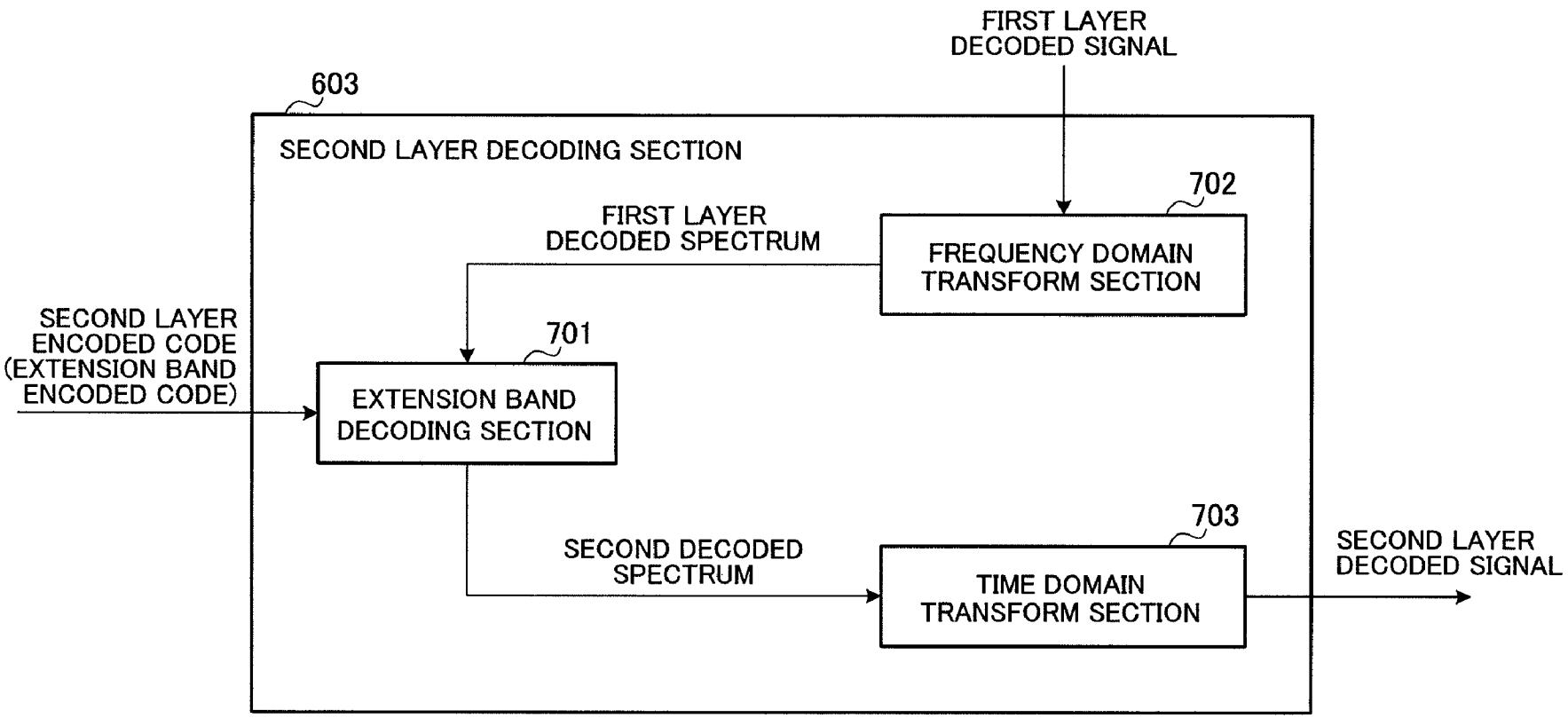
FIG. 7 is a block diagram showing a configuration of a second layer decoding section according to Embodiment 1 of the present invention.

The details of the configuration of the second layer decoding section 603 are now described using FIG. 7. In FIG. 7, second layer decoding section 603 is configured with extension band decoding section 701, frequency domain transform section 702 and time domain transform section 703.

Frequency domain transform section 702 converts a first layer decoded signal inputted from first layer decoding section 602 to parameters (for example, MDCT coefficients) for the frequency domain, and outputs the parameters to extension band decoding section 701 as first layer decoded spectrum of spectrum point Nn.

Extension band decoding section 701 decodes each of the various parameters (amplitude adjustment coefficient, lag, spectrum residual shape vector, spectrum residual gain and scale factor) from second layer encoded code (the same as the extension band encoded code in this configuration) inputted from separating section 601. Further, a second spectrum of spectrum point Nw that is a band-extended second decoded spectrum is generated using each of the various decoded parameters and first layer decoded spectrum outputted from frequency domain transform section 702. The second decoded spectrum is then outputted to time domain transform section 703.

Time domain transform section 703 carries out processing such as appropriate windowing and overlapped addition as necessary after transforming the second decoded spectrum to a time-domain signal, avoids discontinuities occurring between frames, and outputs a second layer decoded signal.

Figure 8:
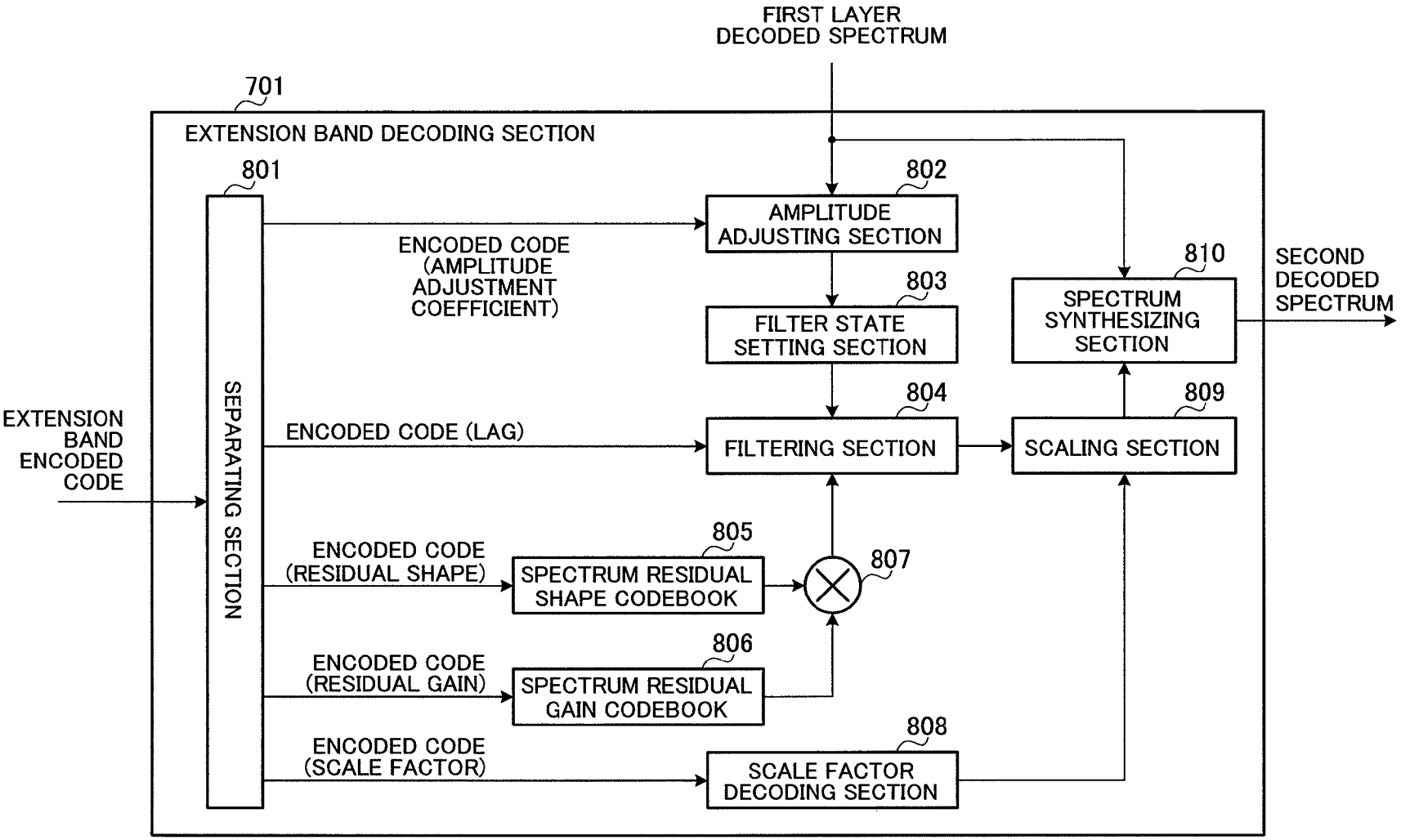
FIG. 8 is a block diagram showing a configuration of an extension band decoding section according to Embodiment 1 of the present invention.

Next, extension band decoding section 701 will be described in more detail using FIG. 8. In FIG. 8, extension band decoding section 701 is configured with separating section 801, amplitude adjusting section 802, filter state setting section 803, filtering section 804, spectrum residual shape codebook 805, spectrum residual gain codebook 806, multiplier 807, scale factor decoding section 808, scaling section 809 and spectrum synthesizing section 810.

Separating section 801 separates extension band encoded code inputted from separating section 601 into an amplitude-adjusted coefficient encoded code, a lag encoded code, a residual shape encoded code, a residual gain encoded code and a scale factor encoded code. Further, the amplitude adjustment coefficient encoded code is outputted to amplitude adjusting section 802, the lag encoded code is outputted to filtering section 804, the residual shape encoded code is outputted to spectrum residual shape codebook 805, the residual gain encoded code is outputted to spectrum residual gain codebook 806, and the scale factor encoded code is outputted to scale factor decoding section 808.

Amplitude adjusting section 802 decodes the amplitude adjustment coefficient encoded code inputted from separating section 801, adjusts the amplitude of the first layer decoded spectrum separately inputted from frequency domain transform section 702, and outputs the amplitude-adjusted first layer decoded spectrum to filter state setting section 803. Amplitude adjustment is carried out using a method shown in the above-described equation 1. Here, S1(k) is a first layer decoded spectrum, and S1'(k) is the amplitude-adjusted first layer decoded spectrum.

Filter state setting section 803 sets the amplitude-adjusted first layer decoded spectrum at the filter state of the pitch filter of the transfer function expressed in the above-described equation 2. Specifically, the amplitude-adjusted first layer decoded spectrum {S1'(k) $0 \leqq k < Nn$} is assigned to spectrum generation buffer S(k), and is outputted to filtering section 804. Here T is the lag of the pitch filter. Further, spectrum generation buffer S(k) is an array variable defined in the range of k=0 to Nw−1, and a spectrum of point (Nw-Nn) is generated by this filtering processing.

Filtering section 804 carries out filtering processing using spectrum generation buffer S(k) inputted from filter state setting section 803 and decoded lag T generated by the lag encoded code from separating section 801. Specifically, output spectrum {S(k); $Nn \leqq k < Nw$} is generated by the method shown in the above-described equation 3. Here, g(j) is spectrum residual gain expressed by residual gain encoded code j, C(i, k) express spectrum residual shape vectors expressed by residual shape encoded code i, respectively. g(j)·C(i, k) is inputted from multiplier 807. Generated output spectrum {S(k); $Nn \leqq k < Nw$} of filtering section 804 is outputted to scaling section 809.

Spectrum residual shape codebook 805 decodes the residual shape encoded code inputted from separating section 801 and outputs spectrum residual shape vector C(i, k) corresponding to the decoding result to multiplier 807.

Spectrum residual gain codebook 806 decodes the residual gain encoded code inputted from separating section 801 and outputs spectrum residual gain g(j) corresponding to the decoding result to multiplier 807.

Multiplier 807 outputs the result of multiplying spectrum residual shape vector C(i, k) inputted from spectrum residual shape codebook 805 by spectrum residual gain g(j) inputted from spectrum residual gain codebook 806 to filtering section 804.

Scale factor decoding section 808 decodes the scale factor encoded code inputted from separating section 801 and outputs the decoded scale factor to scaling section 809.

Scaling section 809 multiplies a scale factor inputted from scale factor decoding section 808 by output spectrum {S(k); $Nn \leqq k < Nw$} supplied from filtering section 804 and outputs the multiplication result to spectrum synthesizing section 810.

Spectrum synthesizing section 810 then outputs the spectrum obtained by integrating first layer decoded spectrum {S(k); $0 \leqq k < Nn$} provided by frequency domain transform section 702 and high frequency band {S(k); $Nn \leqq k < Nw$} of the spectrum generation buffer after scaling outputted from scaling section 809 to time domain transform section 703 as the second decoded spectrum.

Embodiment 2

Figure 9:
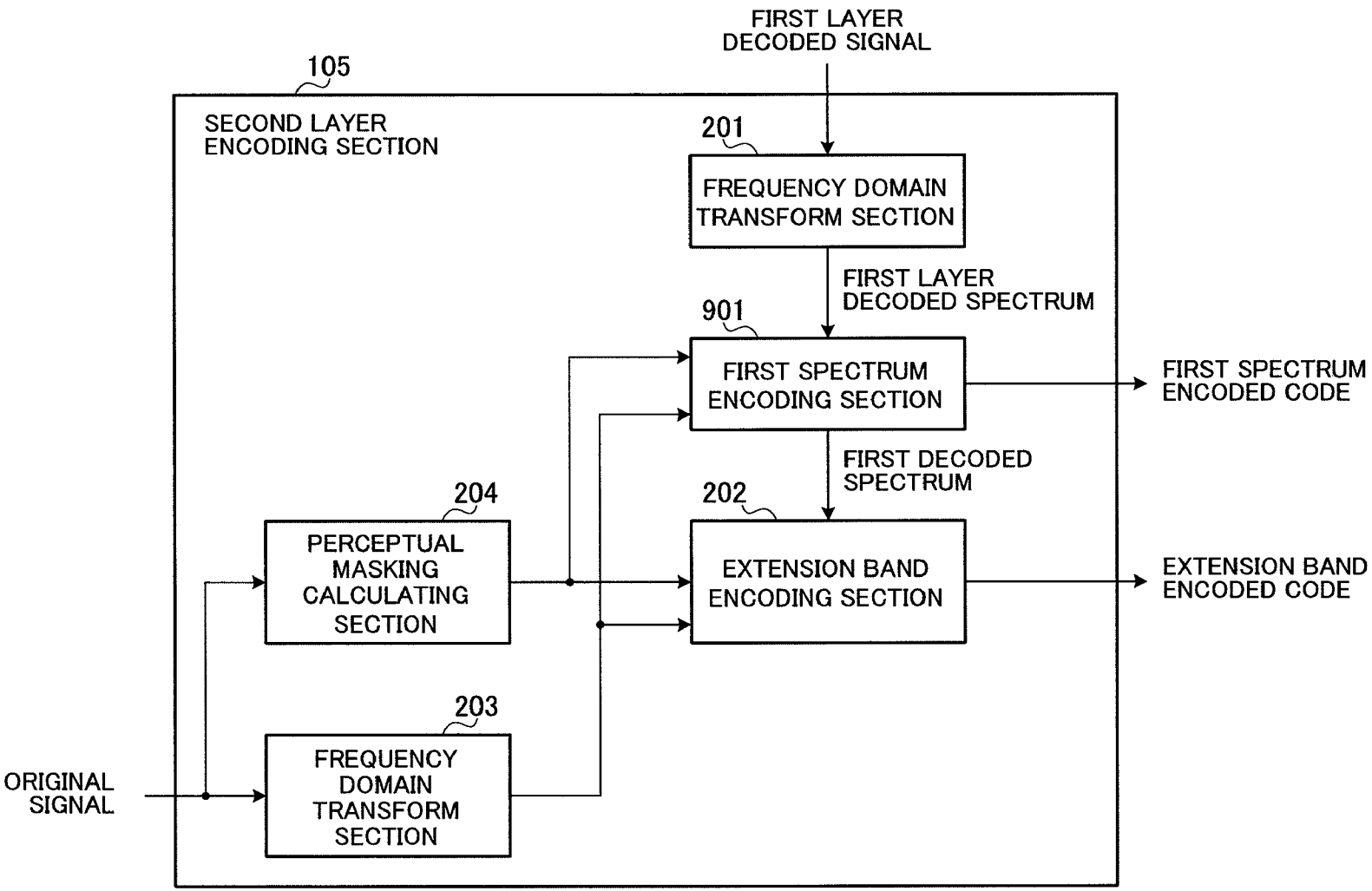
FIG. 9 is a block diagram showing a configuration of a second layer encoding section according to Embodiment 2 of the present invention.

A configuration of second layer encoding section 105 according to Embodiment 2 of the present invention is shown in FIG. 9. In FIG. 9, blocks having the same names as in FIG. 2 have the same function, and therefore description thereof will be omitted here. The difference between FIG. 2 and FIG. 9 is that first spectrum encoding section 901 exists between frequency domain transform section 201 and extension band encoding section 202. First spectrum encoding section 901 improves the quality of a first layer decoded spectrum outputted from frequency domain transform section 201, outputs an encoded code (first spectrum encoded code) at this time to multiplexing section 104, and provides a first layer decoded spectrum (first decoded spectrum) of improved quality to extension band encoding section 202. Extension band encoding section 202 carries out the processing using first decoded spectrum and outputs an extension band encoded code as a result. Namely, the second layer encoded code of this embodiment is a combination of the extension band encoded code and the first spectrum encoded code. Therefore, in this embodiment, multiplexing section 104 multiplexes a first layer encoded code, extension band encoded code and first spectrum encoded code, and generates a bitstream.

Figure 10:
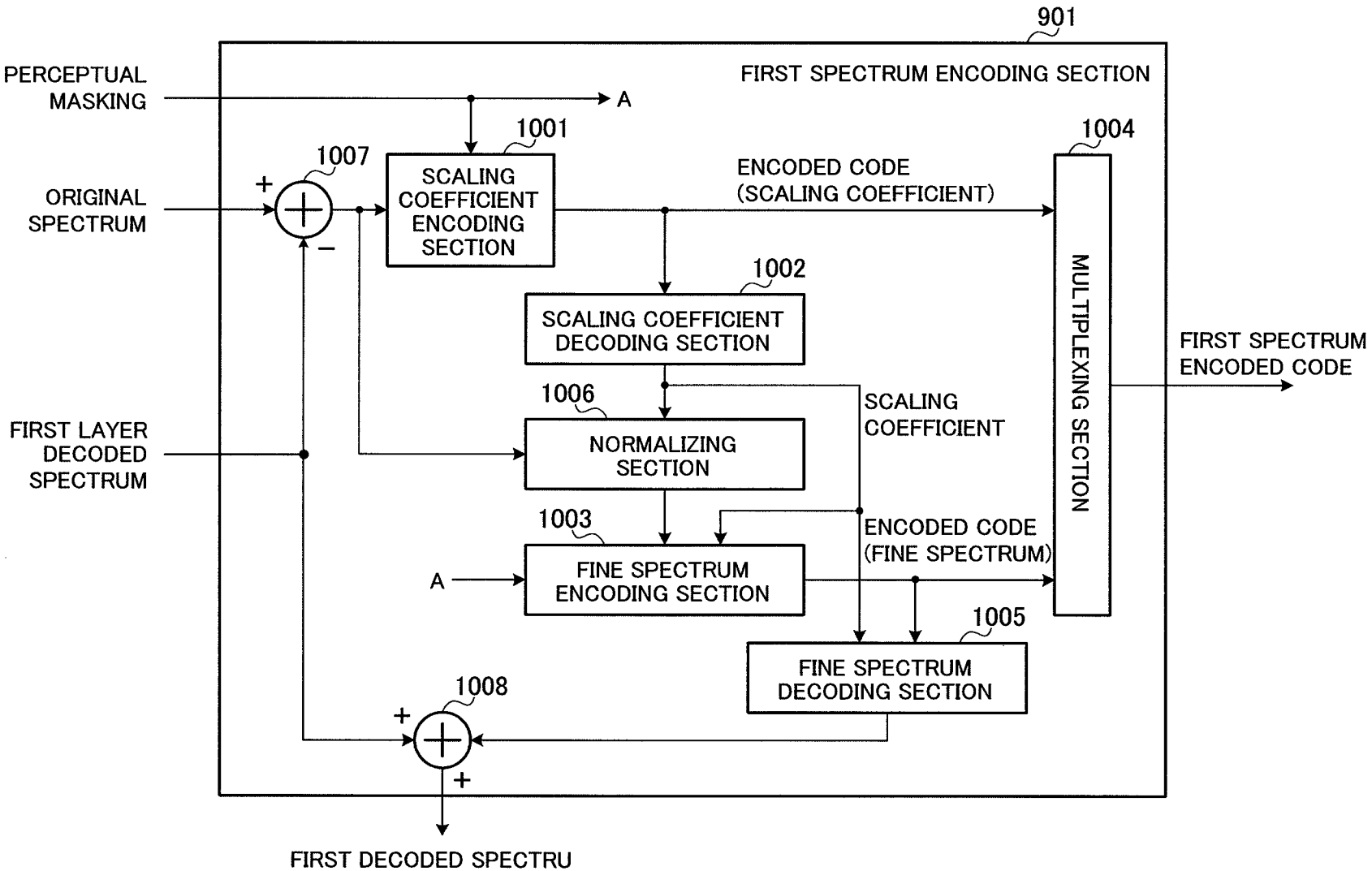
FIG. 10 is a block diagram showing a configuration of a first spectrum encoding section according to Embodiment 2 of the present invention.

Next, the details of first spectrum encoding section 901 will be described using FIG. 10. First spectrum encoding section 901 is configured with scaling coefficient encoding section 1001, scaling coefficient decoding section 1002, fine spectrum encoding section 1003, multiplexing section 1004, fine spectrum decoding section 1005, normalizing section 1006, subtractor 1007 and adder 1008.

Subtractor 1007 subtracts first layer decoded spectrum from the original spectrum to generate a residual spectrum, and outputs the result to scaling coefficient encoding section 1001 and normalizing section 1006. Scaling coefficient encoding section 1001 calculates scaling coefficients expressing a spectrum envelope of residual spectrum, encodes the scaling coefficients, and outputs the encoded code to multiplexing section 1004 and scaling coefficient decoding section 1002.

It is preferable to use perceptual masking in encoding of the scaling coefficients. For example, bit allocation necessary for encoding scaling coefficients is decided using perceptual masking, and encoding is carried out based on this bit allocation information. At this time, when there are bands where there are no bits allocated at all, the scaling coefficients for such a band are not encoded. As a result, it is possible to efficiently encode scaling coefficients.

Scaling coefficient decoding section 1002 decodes scaling coefficients from the inputted scaling coefficient encoded code and outputs decoded scaling coefficients to normalizing section 1006, fine spectrum encoding section 1003 and fine spectrum decoding section 1005.

Normalizing section 1006 then normalizes the residual spectrum supplied from subtractor 1007 using scaling coefficients supplied from scaling coefficient decoding section 1002 and outputs the normalized residual spectrum to fine spectrum encoding section 1003.

Fine spectrum encoding section 1003 calculates perceptual weighting for each band using scaling coefficients inputted from scaling coefficient decoding section 1002, obtains the number of bits allocated to each band, and encodes the normalized residual spectrum (fine spectrum) based on the number of bits. The fine spectrum encoded code obtained using this encoding is then outputted to multiplexing section 1004 and fine spectrum decoding section 1005.

It is also possible to perform encoding so that perceptual distortion becomes small using perceptual masking upon encoding of the normalized residual spectrum. It is also possible to use first layer decoded spectrum information in calculation of perceptual weighting. In this case, a configuration is adopted where the first layer decoded spectrum is inputted to fine spectrum encoding section 1003.

Encoded codes outputted from scaling coefficient encoding section 1001 and fine spectrum encoding section 1003 are multiplexed at multiplexing section 1004 and outputted to multiplexing section 104 as a first spectrum encoded code.

Fine spectrum decoding section 1005 then calculates perceptual weighting for each band using scaling coefficients inputted from scaling coefficient decoding section 1002, obtains the number of bits allocated to each band, decodes the residual spectrum for each band from scaling coefficients and fine spectrum encoded code inputted from fine spectrum encoding section 1003, and outputs a decoded residual spectrum to adder 1008. It is also possible to use first layer decoded spectrum information in calculation of perceptual weighting. In this case, a configuration is adopted where the first layer decoded spectrum is inputted to fine spectrum decoding section 1005.

Adder 1008 then adds the decoded residual spectrum and first layer decoded spectrum so as to generate a first decoded spectrum, and outputs the generated first decoded spectrum to extension band encoding section 202.

According to this embodiment, it is possible to improve the quality of a band-extended decoded signal by generating a spectrum for the high frequency band ($Nn \leqq k < Nw$) at extension band encoding section 202 using the quality improved spectrum after improving quality of the first layer decoded spectrum, that is, using the first spectrum.

Figure 11:
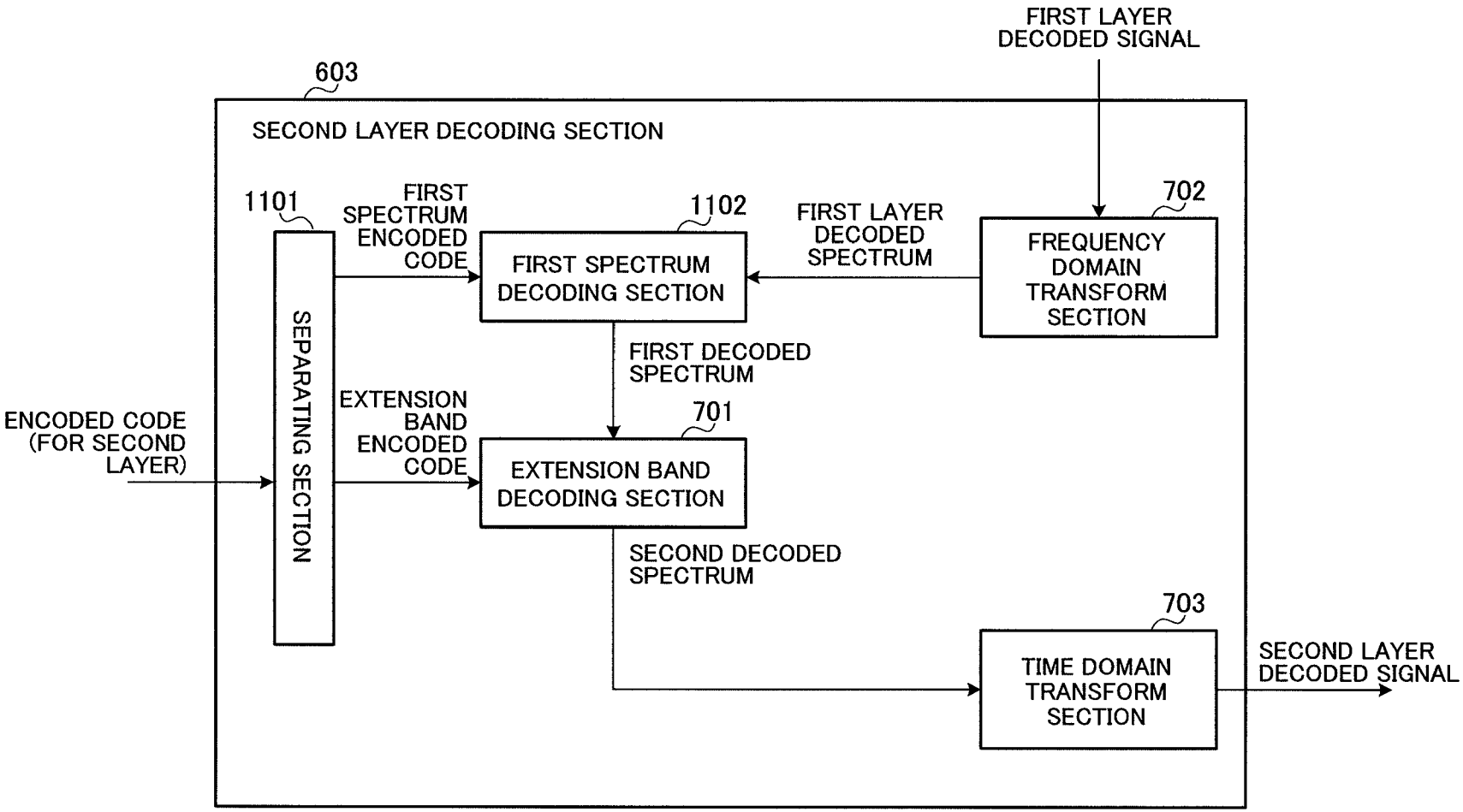
FIG. 11 is a block diagram showing a configuration of a second layer decoding section according to Embodiment 2 of the present invention.

The details of the configuration of second layer decoding section 603 of this embodiment will be described using FIG. 11. In FIG. 11, blocks having the same names as in FIG. 7 have the same function, and therefore description thereof will be omitted. In FIG. 11, second layer decoding section 603 is configured with separating section 1101, first spectrum decoding section 1102, extension band decoding section 701, frequency domain transform section 702 and time domain transform section 703.

Separating section 1101 separates the second layer encoded code into the first spectrum encoded code and the extension band encoded code, outputs the first spectrum encoded code to first spectrum decoding section 1102, and outputs the extension band encoded code to extension band decoding section 701.

Frequency domain transform section 702 converts a first layer decoded signal inputted from first layer decoding section 602 to parameters (for example, MDCT coefficients) in the frequency domain, and outputs the parameters to first spectrum decoding section 1102 as a first layer decoded spectrum.

First spectrum decoding section 1102 adds a quantized spectrum of coding errors of the first layer obtained by decoding the first spectrum encoded code inputted from separating section 1101 to the first layer decoded spectrum inputted from frequency domain transform section 702. The addition result is then outputted to extension band decoding section 701 as a first decoded spectrum.

First spectrum decoding section 1102 will be described using FIG. 12. First spectrum decoding section 1102 has separating section 1201, scaling coefficient decoding section 1202, fine spectrum decoding section 1203, and spectrum decoding section 1204.

Separating section 1201 separates the encoded code indicating scaling coefficients and the encoded code indicating a fine spectrum (spectrum fine structure) from the inputted first spectrum encoded code, outputs a scaling coefficient encoded code to scaling coefficient decoding section 1202, and outputs a fine spectrum encoded code to fine spectrum decoding section 1203.

Scaling coefficient decoding section 1202 decodes scaling coefficients from the inputted scaling coefficient encoded code and outputs decoded scaling coefficients to spectrum decoding section 1204 and fine spectrum decoding section 1203.

Fine spectrum decoding section 1203 calculates an perceptual weighting for each band using scaling coefficients inputted from scaling coefficient decoding section 1202 and obtains the number of bits allocated to fine spectrum of each band. Further, fine spectrum for each band is decoded from the fine spectrum encoded code inputted from separating section 1201, and the decoded fine spectrum is outputted to spectrum decoding section 1204.

It is also possible to use first layer decoded spectrum information in calculation of the perceptual weighting. In this case, a configuration is adopted where the first layer decoded spectrum is inputted to fine spectrum decoding section 1203.

Spectrum decoding section 1204 decodes first decoded spectrum from the first layer decoded spectrum supplied from frequency domain transform section 702, scaling coefficients inputted from scaling coefficient decoding section 1202, and the fine spectrum inputted from fine spectrum decoding section 1203, and outputs this decoded spectrum to extension band decoding section 701.

Figure 13:
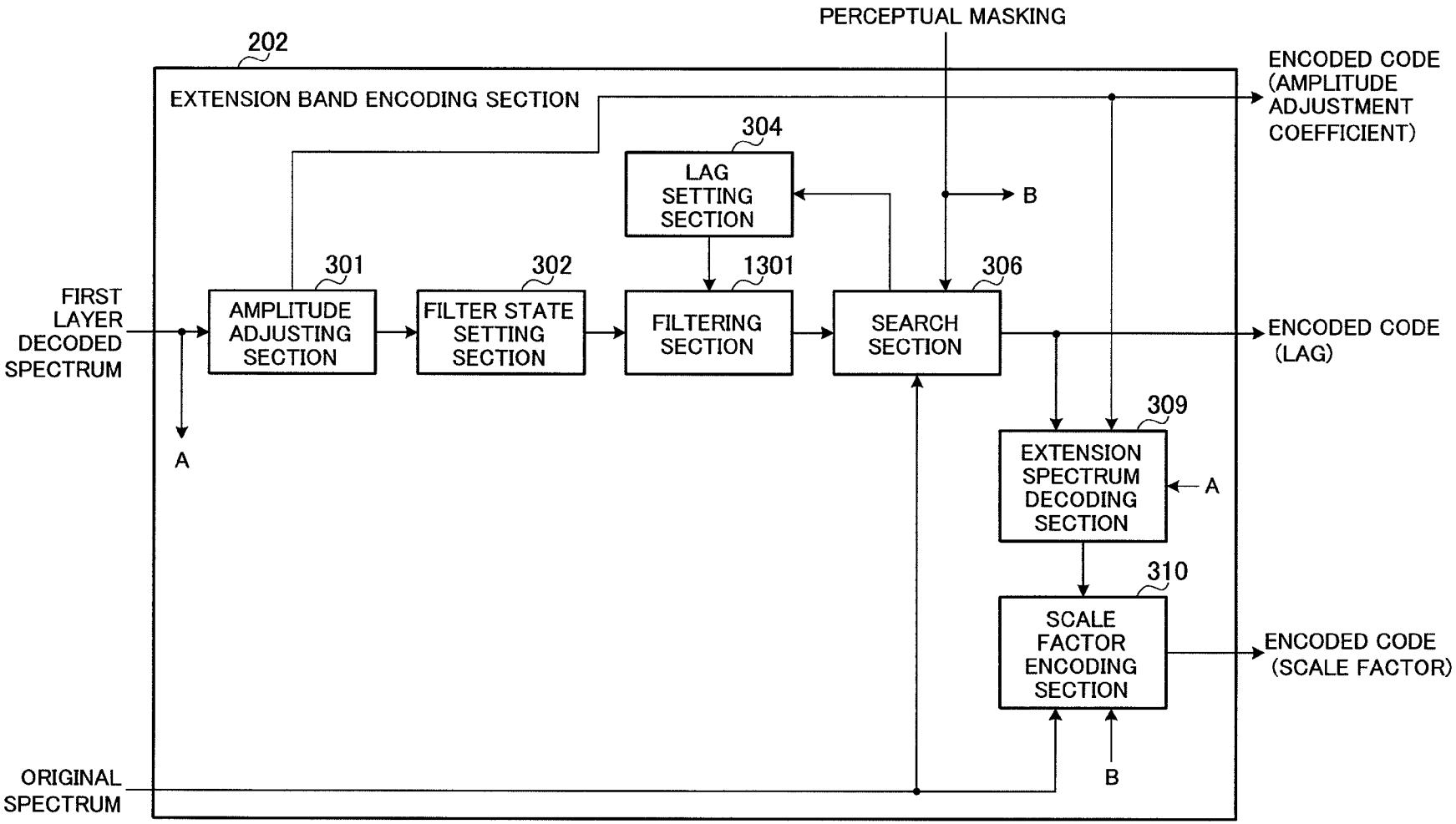
FIG. 13 is a block diagram showing a configuration of an extension band encoding section according to Embodiment 2 of the present invention.
Figure 14:
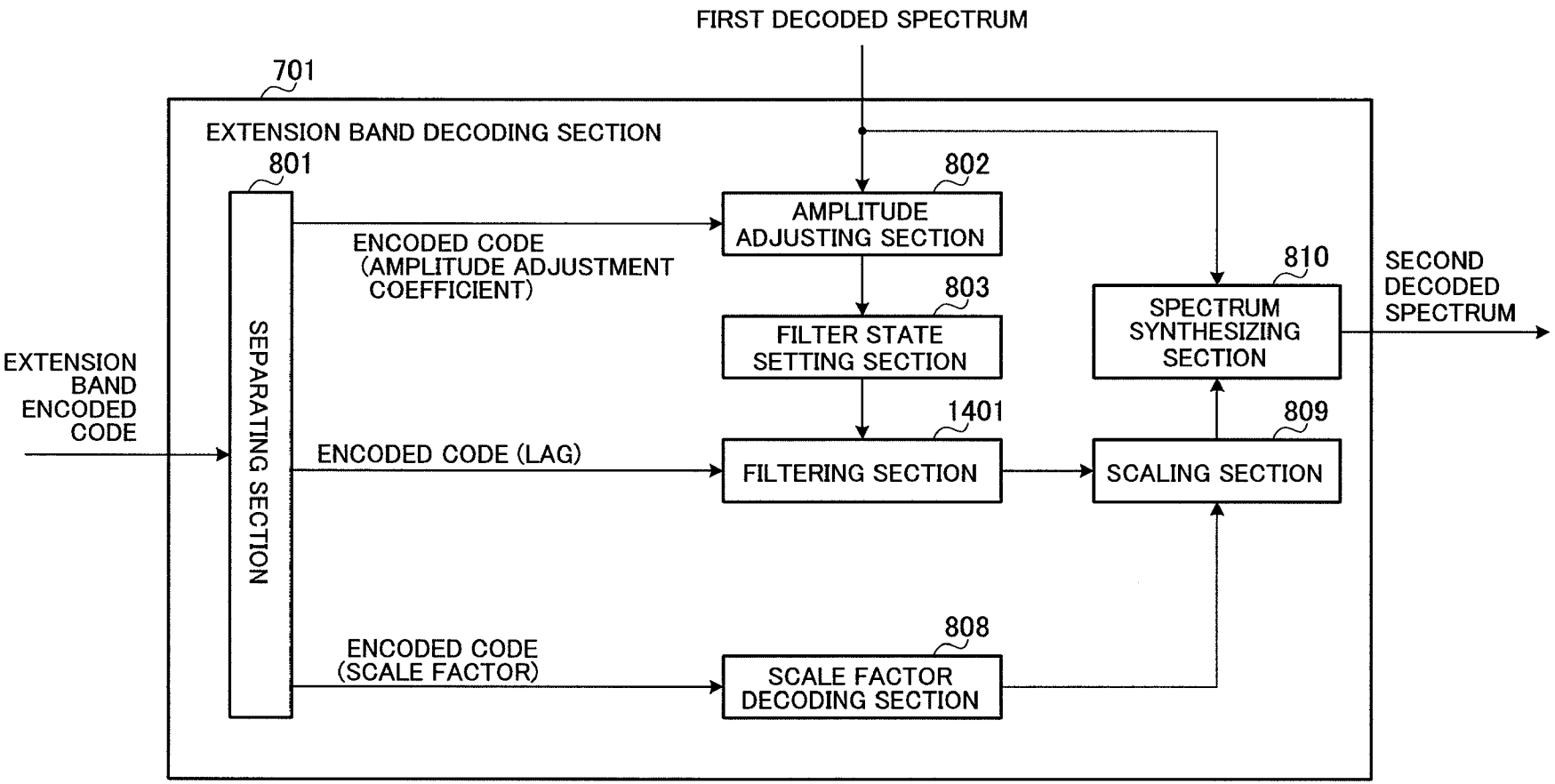
FIG. 14 is a block diagram showing a configuration of an extension band decoding section according to Embodiment 2 of the present invention.

It is not necessary to provide spectrum residual shape codebook 305 and spectrum residual gain codebook 307 at extension band encoding section 202 of this embodiment. A configuration of extension band encoding section 202 in this case is as shown in FIG. 13. It is not necessary to provide spectrum residual shape codebook 805 and spectrum residual gain codebook 806 at extension band decoding section 701. A configuration of extension band decoding section 701 in this case is as shown in FIG. 14. Output signals of filtering sections 1301 and 1401 respectively shown in FIG. 13 and FIG. 14 are expressed by the following equation 6.

$$S(k)=S(k-T)\ Nn \leqq k < Nw \qquad \text{(Equation 6)}$$

In this embodiment, after improving the quality of the first layer decoded spectrum, a spectrum of a high frequency band ($Nn \leqq k < Nw$) is generated at extension band encoding section 202 using this quality improved spectrum. According to this configuration, it is possible to improve the quality of the decoded signal. This advantage can be obtained regardless of the presence or absence of a spectrum residual shape codebook or a spectrum residual gain codebook.

It is also possible to encode the spectrum of the low frequency band ($0 \leqq k < Nn$) so that encoding distortion of the whole band ($0 \leqq k < Nw$) becomes a minimum when the spectrum of the low frequency band ($0 \leqq k < Nn$) is encoded at first spectrum encoding section 901. In this case, at extension band encoding section 202, encoding is carried out for the high frequency band ($Nn \leqq k < Nw$). Further, in this case, encoding of the low frequency band is carried out at first spectrum encoding section 901 taking into consideration the influence of low frequency band encoding results on the high frequency band encoding. Therefore, the spectrum of the low frequency band is encoded so that the spectrum of the whole band is optimized, so that it is possible to obtain the effect of improving quality.

Embodiment 3

Figure 15:
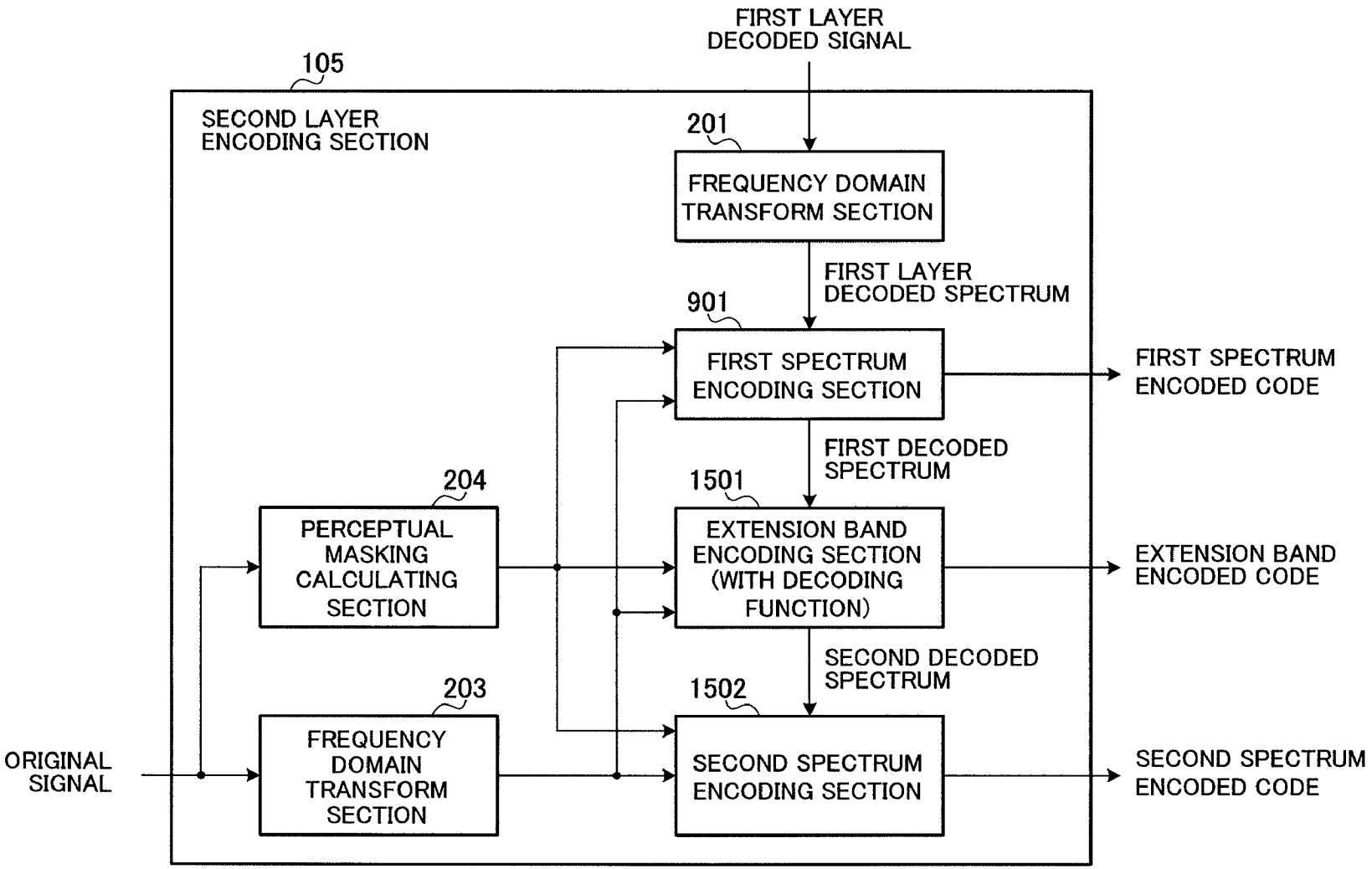
FIG. 15 is a block diagram showing a configuration of a second layer encoding section according to Embodiment 3 of the present invention.

A configuration of second layer encoding section 105 according to Embodiment 3 of the present invention is shown in FIG. 15. In FIG. 15, blocks having the same names as in FIG. 9 have the same function, and therefore description thereof will be omitted here.

A difference with FIG. 9 is that extension band encoding section 1501 that has a decoding function and obtains an extension band encoded code, and second spectrum encoding section 1502 that encodes an error spectrum obtained by generating a second decoded spectrum using this extension band encoded code and subtracting the second decoded spectrum from the original spectrum, are provided. It is possible to generate a decoded spectrum with a higher quality by encoding the error spectrum described above at second spectrum encoding section 1502 and improve the quality of decoded signals obtained using the decoding apparatus.

Extension band encoding section 1501 generates and outputs an extension band encoded code in the same way as extension band encoding section 202 shown in FIG. 3. Further, extension band encoding section 1501 has the same configuration as extension band decoding section 701 shown in FIG. 8, and generates a second decoded spectrum in the same way as extension band decoding section 701. This second decoded spectrum is outputted to second spectrum encoding section 1502. Namely, the second layer encoded code of this embodiment is comprised of an extension band encoded code, a first spectrum encoded code, and a second spectrum encoded code.

It is also possible to share blocks having common names in FIG. 3 and FIG. 8 in the configuration of extension band encoding section 1501.

Figure 16:
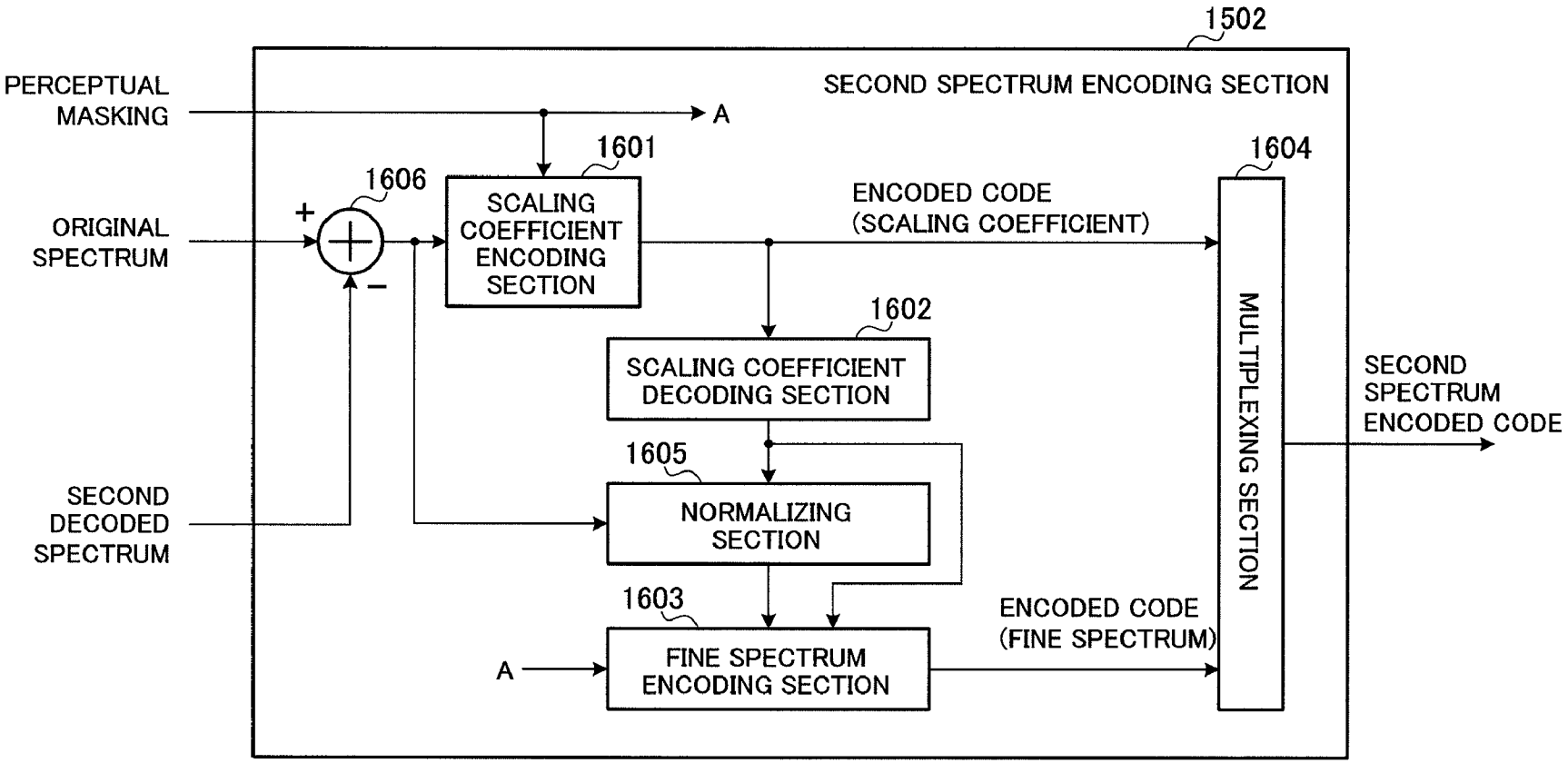
FIG. 16 is a block diagram showing a configuration of a second spectrum encoding section according to Embodiment 3 of the present invention.

As shown in FIG. 16, second spectrum encoding section 1502 is configured with scaling coefficient encoding section 1601, scaling coefficient decoding section 1602, fine spectrum encoding section 1603, multiplexing section 1604, normalizing section 1605 and subtractor 1606.

Subtractor 1606 subtracts the second decoded spectrum from the original spectrum to generate a residual spectrum, and outputs the residual spectrum to scaling coefficient encoding section 1601 and normalizing section 1605. Scaling coefficient encoding section 1601 calculates scaling coefficients indicating a spectrum envelope of residual spectrum, encodes the scaling coefficients, and outputs the scaling coefficient encoded code to multiplexing section 1604 and scaling coefficient decoding section 1602.

Here, it is also possible to efficiently encode scaling coefficients using perceptual masking. For example, bit allocation necessary for encoding scaling coefficients is decided using perceptual masking, and encoding is carried out based on this bit allocation information. At this time, when there are bands where there are no bits allocated at all, the scaling coefficients for such a band are not encoded.

Scaling coefficient decoding section 1602 decodes scaling coefficients from the inputted scaling coefficient encoded code and outputs decoded scaling coefficients to normalizing section 1605 and fine spectrum encoding section 1603.

Normalizing section 1605 then normalizes the residual spectrum supplied from subtractor 1606 using the scaling coefficients supplied from scaling coefficient decoding section 1602 and outputs the normalized residual spectrum to fine spectrum encoding section 1603.

Fine spectrum encoding section 1603 calculates an perceptual weighting for each band using the decoding scaling coefficients inputted from scaling coefficient decoding section 1602, obtains the number of bits allocated to each band, and encodes the normalized residual spectrum (fine spectrum) based on the condition of the number of bits. The encoded code obtained as a result of this encoding is then outputted to multiplexing section 1604.

It is also possible to perform encoding so that perceptual distortion becomes small using perceptual masking upon encoding of the normalized residual spectrum. It is also possible to use the second layer decoded spectrum information in calculation of the perceptual weighting. In this case, a configuration is adopted where the second layer decoded spectrum is inputted to fine spectrum encoding section 1603.

The encoded codes outputted from scaling coefficient encoding section 1601 and fine spectrum encoding section 1603 are multiplexed at multiplexing section 1604 and outputted as a second spectrum encoded code.

Figure 17:
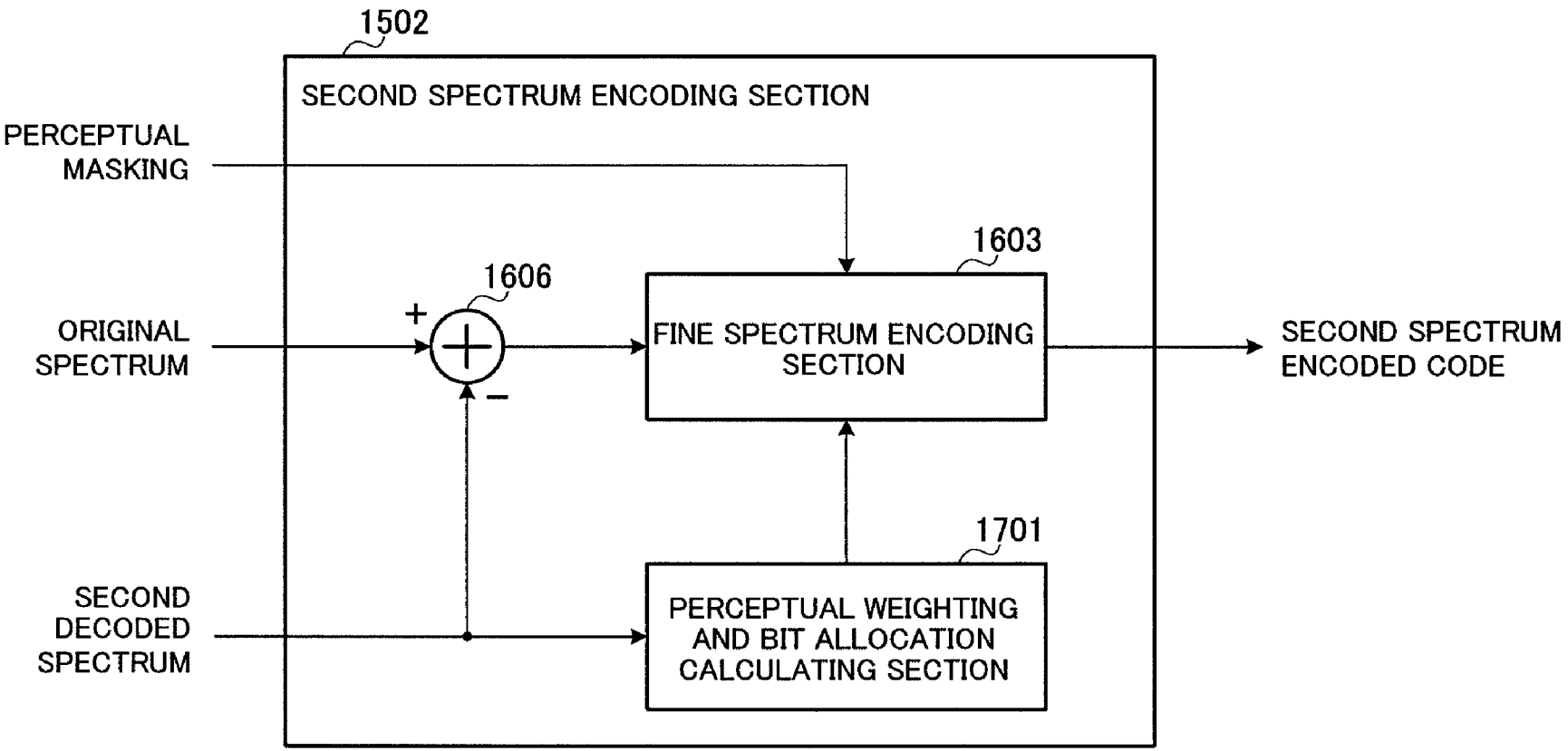
FIG. 17 is a block diagram showing a modified example of a configuration of the second spectrum encoding section according to Embodiment 3 of the present invention.

FIG. 17 shows a modified example of a configuration of second spectrum encoding section 1502. In FIG. 17, blocks having the same names as in FIG. 16 have the same function, and therefore description thereof will be omitted.

In this configuration, second spectrum encoding section 1502 directly encodes the residual spectrum supplied from subtractor 1606. Namely, the residual spectrum is not normalized. As a result, in this configuration, scaling coefficient encoding section 1601, scaling coefficient decoding section 1602 and normalizing section 1605 shown in FIG. 16 are not provided. According to this configuration, it is not necessary to allocate bits to scaling coefficients at second spectrum encoding section 1502, so that it is possible to reduce the bit rate.

Perceptual weighting and bit allocation calculating section 1701 obtains an perceptual weighting for each band from the second decoded spectrum, and obtains bit allocation to each band decided according to the perceptual weighting. The obtained perceptual weighting and bit allocation are outputted to fine spectrum encoding section 1603.

Fine spectrum encoding section 1603 encodes the residual spectrum based on the perceptual weighting and bit allocation inputted from perceptual weighting and bit allocation calculating section 1701. The encoded code obtained as a result of this encoding is then outputted to multiplexing section 104 as a second spectrum encoded code. It is also possible to perform encoding so that perceptual distortion becomes small using perceptual masking upon encoding of the residual spectrum.

Figure 18:
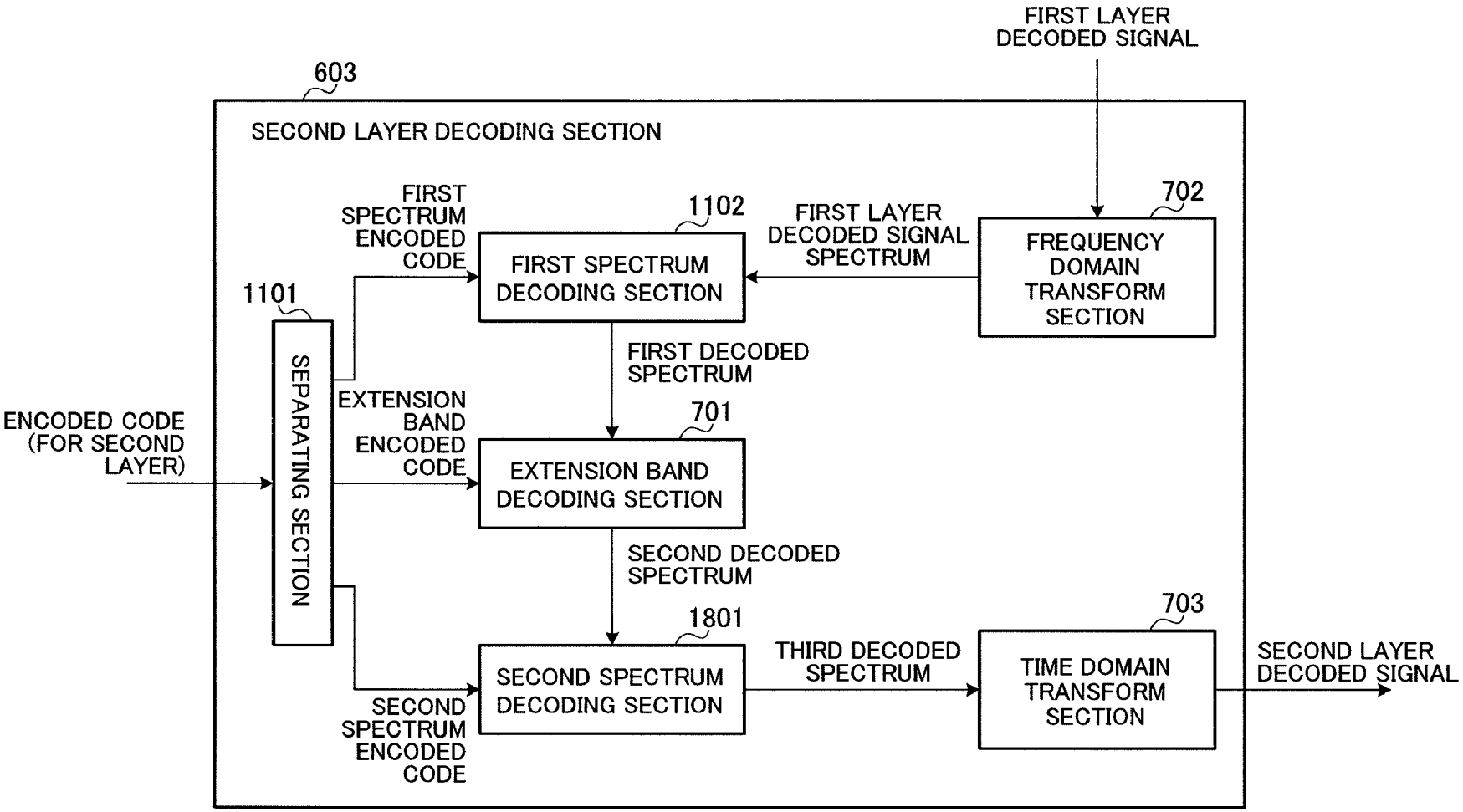
FIG. 18 is a block diagram showing a configuration of a second layer decoding section according to Embodiment 3 of the present invention.

The configuration of second layer decoding section 603 of this embodiment is shown in FIG. 18. Second layer decoding section 603 is configured with extension band decoding section 701, frequency domain transform section 702, time domain transform section 703, separating section 1101, first spectrum decoding section 1102 and second spectrum decoding section 1801. In FIG. 18, blocks having the same names as in FIG. 11 have the same function, and therefore description thereof will be omitted.

Second spectrum decoding section 1801 adds a spectrum in which coding errors of the second decoded spectrum obtained by decoding the second spectrum encoded code inputted from separating section 1101 are quantized, to second decoded spectrum inputted from extension band decoding section 701. The addition result is then outputted to time domain transform section 703 as third decoded spectrum.

Figure 12:
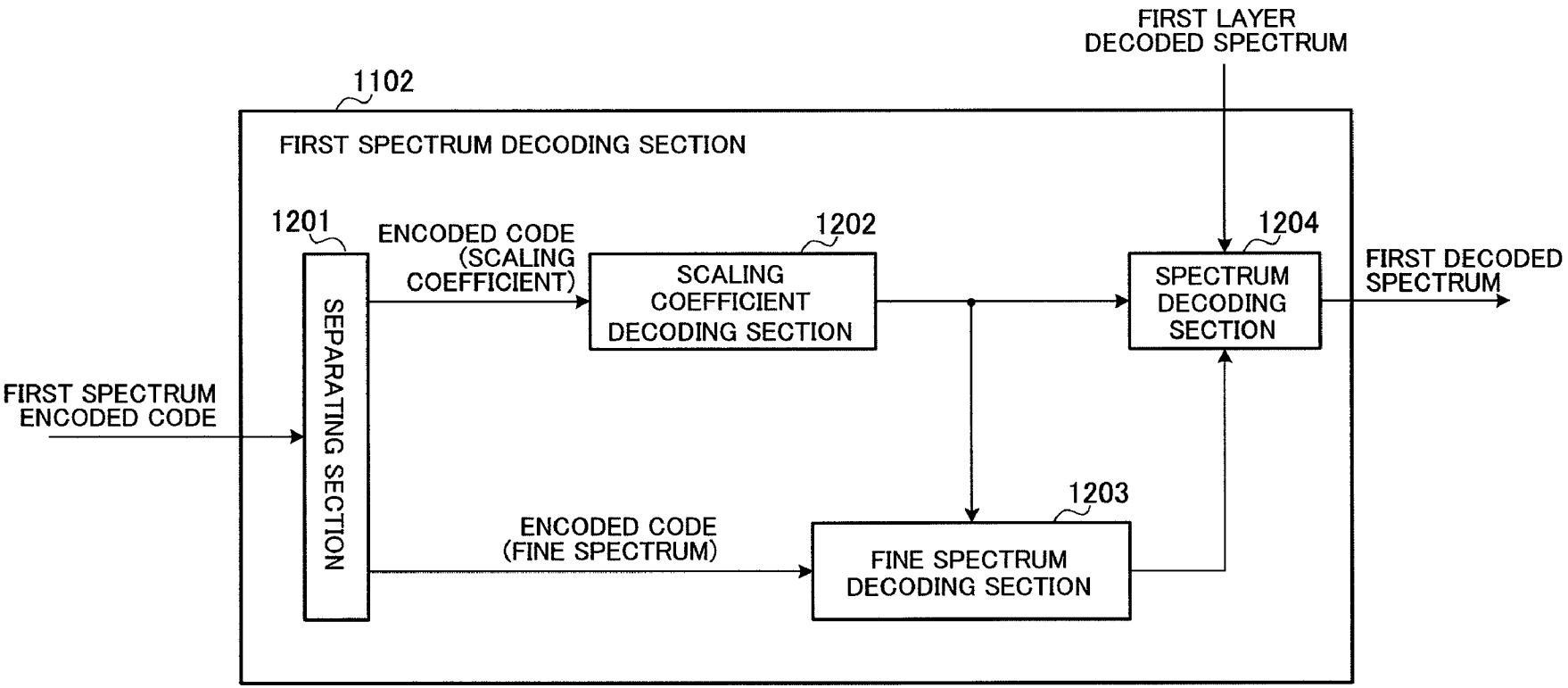
FIG. 12 is a block diagram showing a configuration of a first spectrum decoding section according to Embodiment 2 of the present invention.

Second spectrum decoding section 1801 adopts the same configuration as for FIG. 12 when second spectrum encoding section 1502 adopts the configuration shown in FIG. 16. The first spectrum encoded code, first layer decoded spectrum and first decoded spectrum shown in FIG. 12 are substituted with the second spectrum encoded code, second decoded spectrum and third decoded spectrum, respectively.

Figure 19:
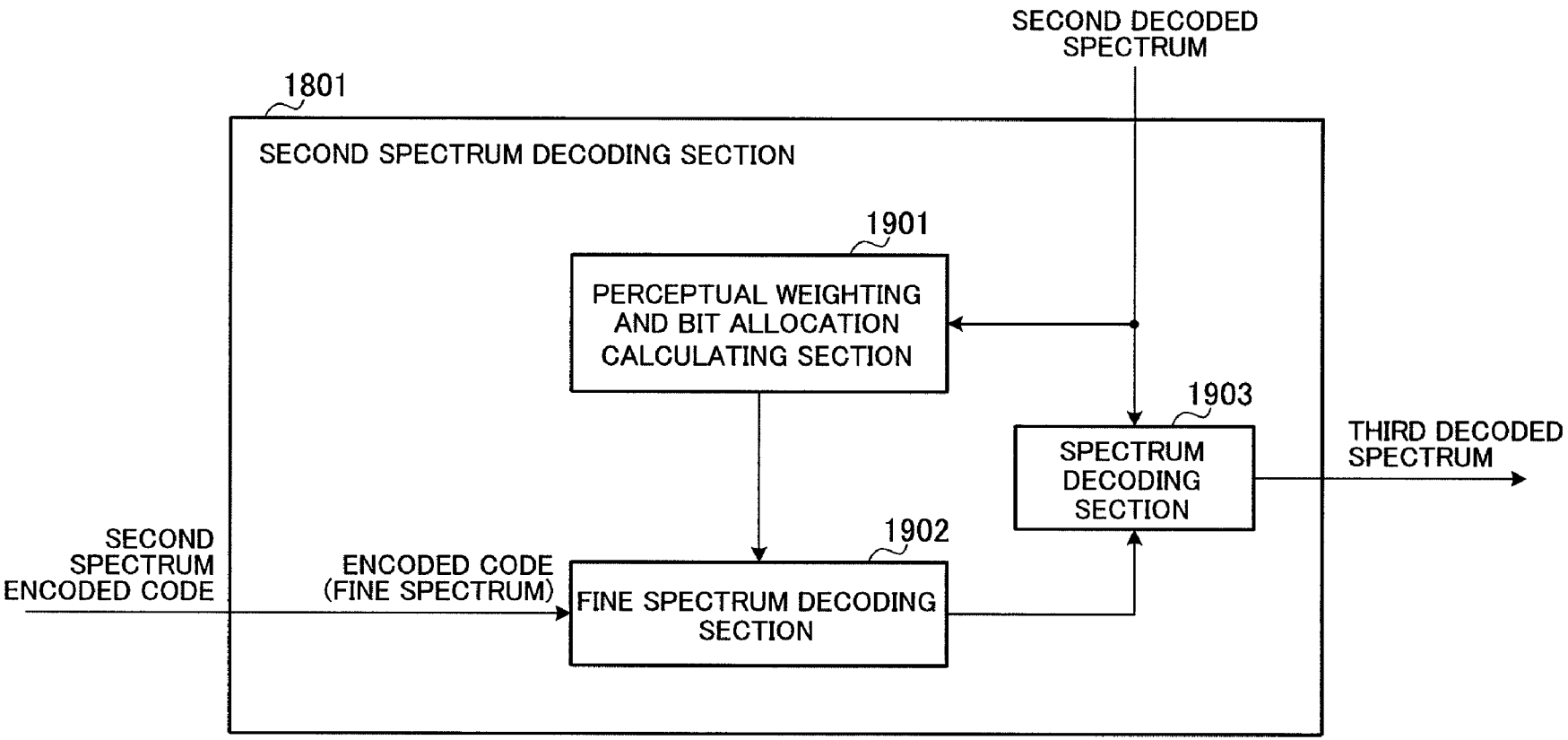
FIG. 19 is a block diagram showing a modified example of a configuration of a second spectrum decoding section according to Embodiment 3 of the present invention.

In this embodiment, the case has been described as an example where second spectrum encoding section 1502 adopts the configuration shown in FIG. 16 in the configuration of second spectrum decoding section 1801, but, when second spectrum encoding section 1502 adopts the configuration shown in FIG. 17, the configuration of second spectrum decoding section 1801 becomes as shown in FIG. 19.

Namely, FIG. 19 shows a configuration of second spectrum decoding section 1801 corresponding to second spectrum encoding section 1502 that does not use scaling coefficients. Second spectrum decoding section 1801 is configured with perceptual weighting and bit allocation calculating section 1901, fine spectrum decoding section 1902 and spectrum decoding section 1903.

In FIG. 19, perceptual weighting and bit allocation calculating section 1901 obtains an perceptual weighting for each band from the second decoded spectrum inputted from extension band decoding section 701, and obtains bit allocation to each band decided according to the perceptual weighting. The obtained perceptual weighting and bit allocation are outputted to fine spectrum decoding section 1902.

Fine spectrum decoding section 1902 decodes the fine spectrum encoded code inputted as a second spectrum encoded code from separating section 1101 based on the perceptual weighting and bit allocation inputted from perceptual weighting and bit allocation calculating section 1901 and outputs the decoding result (fine spectrum for each band) to spectrum decoding section 1903.

Spectrum decoding section 1903 adds the fine spectrum inputted from fine spectrum decoding section 1902 to the second decoded spectrum inputted from extension band decoding section 701 and outputs the addition result to outside as a third decoded spectrum.

Figure 20:
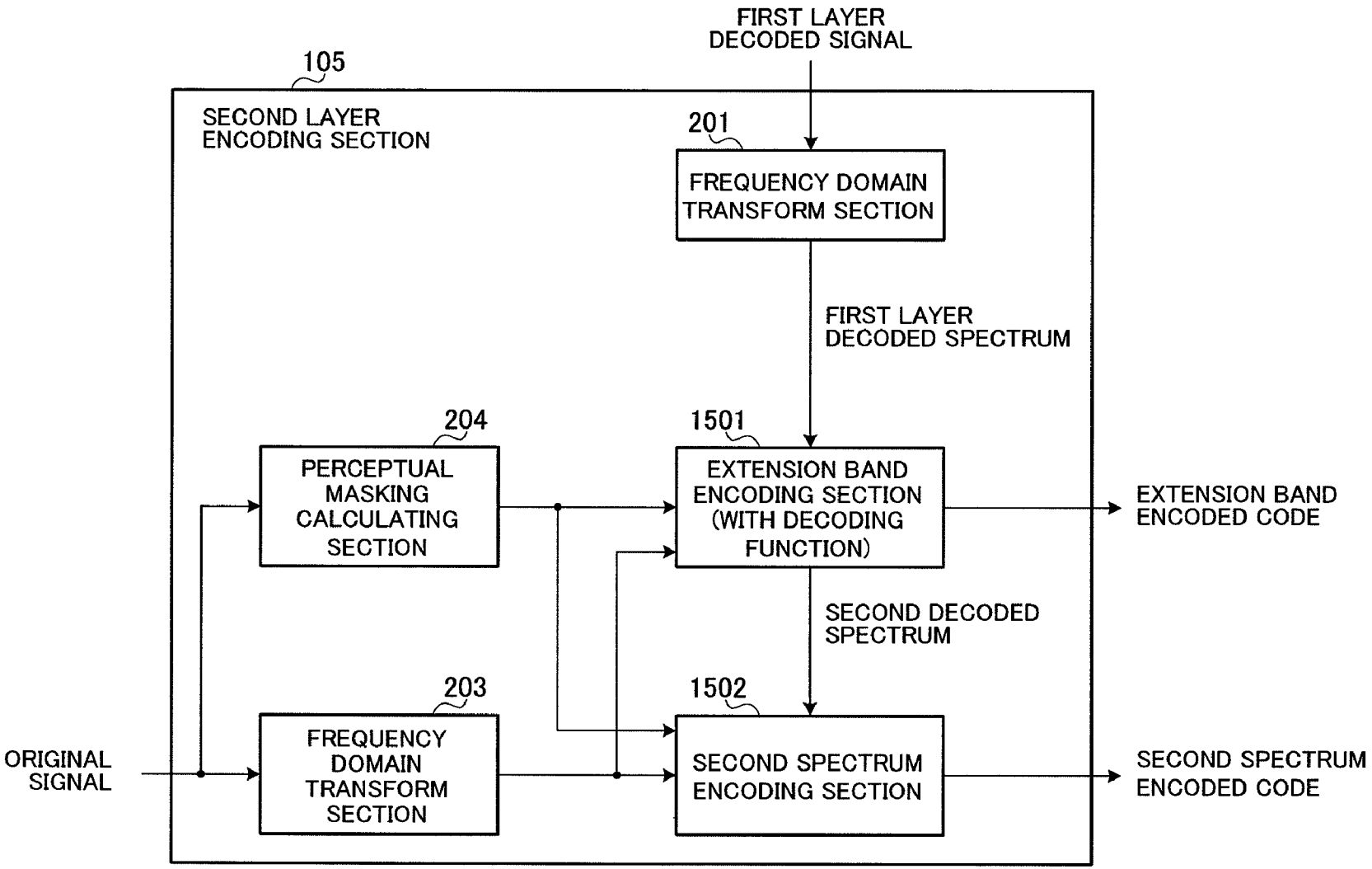
FIG. 20 is a block diagram showing a modified example of a configuration of a second layer encoding section according to Embodiment 3 of the present invention.
Figure 21:
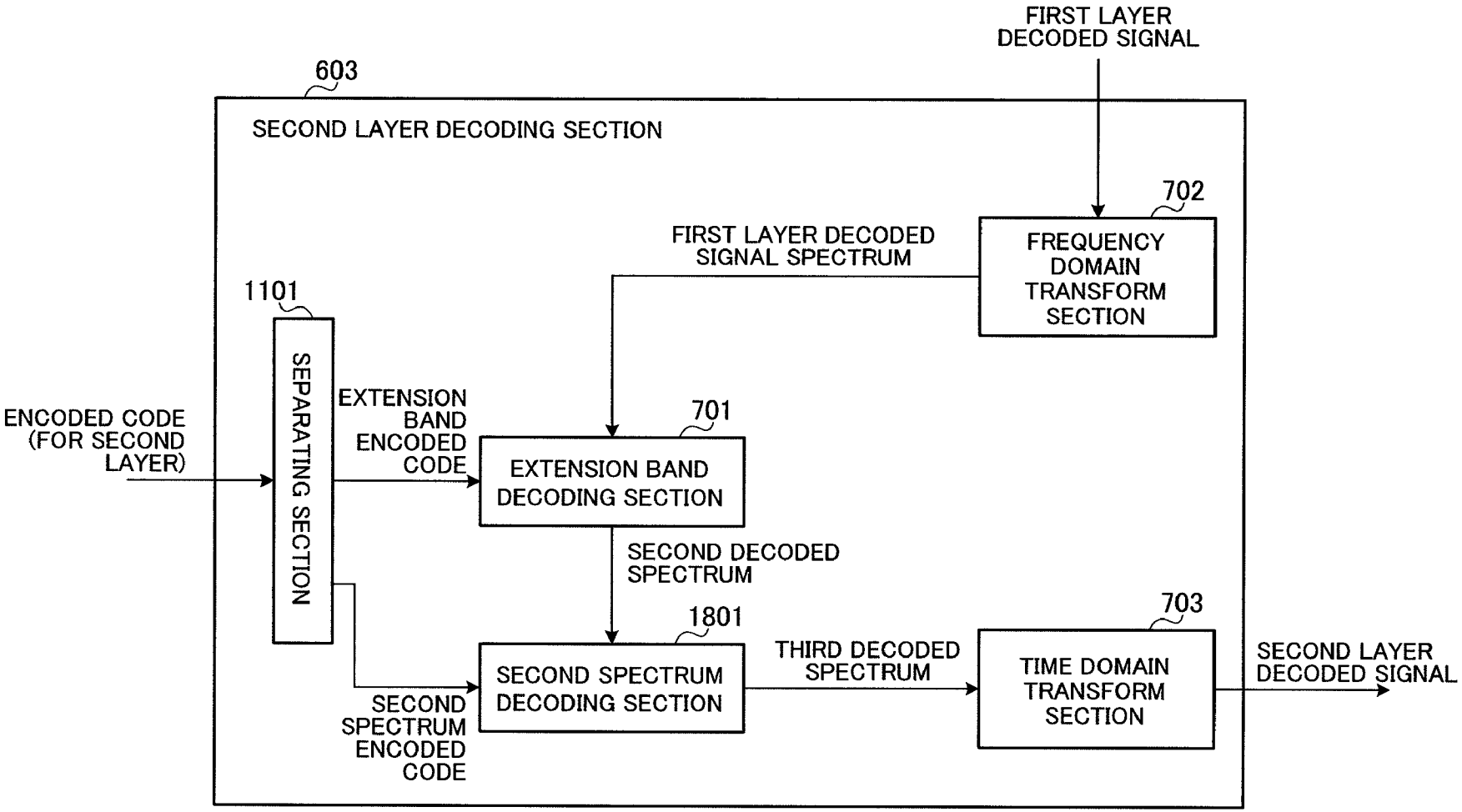
FIG. 21 is a block diagram showing a modified example of a configuration of a second layer decoding section according to Embodiment 3 of the present invention.

In this embodiment, the configuration has been described as an example containing first spectrum encoding section 901 and first spectrum decoding section 1101, but it is also possible to implement the operation effects of this embodiment without first spectrum encoding section 901 and first spectrum decoding section 1102. The configuration of second layer encoding section 105 in this case is shown in FIG. 20, and the configuration of second layer decoding section 603 is shown in FIG. 21.

Embodiments of the scalable decoding apparatus and scalable encoding apparatus of the present invention has been described.

In the above embodiments, MDCT is used as the transform scheme, but this is by no means limiting, and the present invention can also be applied using other transform schemes such as, for example, Fourier transform, cosine transform and wavelet transform.

In the above embodiments, a description is given based on the number of layers of two, but this is by no means limiting, and application is also possible in scalable encoding/decoding having two or more layers.

The encoding apparatus and decoding apparatus according to the present invention is by no means limited to Embodiments 1 to 3 described above, and various modifications thereof are possible. For example, each of the embodiments may be appropriately combined.

The encoding apparatus and decoding apparatus according to the present invention can be provided on a communication terminal apparatus and a base station apparatus in a mobile communication system, so that it is possible to provide a communication terminal apparatus and a base station apparatus having the same operation effects as described above.

Moreover, the case has been described as an example where the present invention is implemented with hardware, the present invention can be implemented with software.

Furthermore, each function block used to explain the above-described embodiments is typically implemented as an LSI constituted by an integrated circuit. These may be individual chips or may partially or totally contained on a single chip.

Here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

Namely, the scalable encoding apparatus according to the above embodiments generates low-frequency-band encoding information and high-frequency-band encoding information from an original signal and adopts a configuration including: a first spectrum calculating section that calculates a first spectrum of a low frequency band from a decoded signal of the low-frequency-band encoding information; a second spectrum calculating section that calculates a second spectrum from the original signal; a first parameter calculating section that calculates a first parameter indicating a degree of similarity between the first spectrum and a high frequency band of the second spectrum; a second parameter calculating section that calculates a second parameter indicating a fluctuation component between the first spectrum and the high frequency band of the second spectrum; and an encoding section that encodes the calculated first parameter and second parameter as the high-frequency-band encoding information.

Further, the scalable encoding apparatus according to the above embodiments adopts a configuration wherein the first parameter calculating section outputs a parameter indicating a characteristic of a filter as the first parameter using the filter having the first spectrum as an internal state.

Moreover, the scalable encoding apparatus according to the above embodiments adopts a configuration wherein, in the above configuration, the second parameter calculating section has a spectrum residual shape codebook recorded with a plurality of spectrum residual candidates and outputs a code of the spectrum residual as the second parameter.

Further, the scalable encoding apparatus according to the above embodiments, in the above configuration, further includes a residual component encoding section encoding a residual component between the first spectrum and a low frequency band of the second spectrum, wherein the first parameter calculating section and second parameter calculating section calculate the first parameter and the second parameter after improving quality of the first spectrum using the residual component encoded by the residual component encoding section.

Further, the scalable encoding apparatus according to the above embodiments, in the above configuration, adopts a configuration wherein the residual component encoding section improves both quality of the low frequency band of the first spectrum and quality of a high frequency band of the decoded spectrum obtained from the first parameter and the second parameter encoded by the encoding section.

Further, the scalable encoding apparatus according to the above embodiments, in the above configuration, adopts a configuration wherein: the first parameter contains a lag; the second parameter contains a spectrum residual; and the encoding apparatus further includes a configuration section that configures a bitstream arranged in order of the lag and the spectrum residual.

The scalable encoding apparatus according to the above embodiments generates low-frequency-band encoding information and high-frequency-band encoding information from an original signal and adopts a configuration including: a first spectrum calculating section that calculates a first spectrum of a low frequency band from a decoded signal of the low-frequency-band encoding information; a second spectrum calculating section that calculates a second spectrum from the original signal; a parameter calculating section that calculates a parameter indicating a degree of similarity between the first spectrum and a high frequency band of the second spectrum; a parameter encoding section that encodes the calculated parameter as high-frequency-band encoding information; and a residual component encoding section that encodes a residual component between the first spectrum and a low frequency band of the second spectrum, wherein the parameter calculating section calculates the parameter after improving quality of the first spectrum using the residual component encoded by the residual component encoding section.

The scalable decoding apparatus according to the above embodiments adopts a configuration including: a spectrum acquiring section that acquires a first spectrum corresponding to a low frequency band; a parameter acquiring section that respectively acquires a first parameter that is encoded as high-frequency-band encoding information and indicates a degree of similarity between the first spectrum and a high frequency band of the second spectrum corresponding to an original signal, and a second parameter that is encoded as high-frequency-band encoding information and indicates a fluctuation component between the first spectrum and the high frequency band of the second spectrum; and a decoding section that decodes the second spectrum using the acquired first parameter and second parameter.

The scalable encoding method according to the above embodiments for generating low-frequency-band encoding information and high-frequency-band encoding information from an original signal, adopts a configuration including: a first spectrum calculating step of calculating a first spectrum of a low frequency band from a decoded signal of the low-frequency-band encoding information; a second spectrum calculating step of calculating a second spectrum from the original signal; a first parameter calculating step of calculating a first parameter indicating a degree of similarity between the first spectrum and a high frequency band of the second spectrum; a second parameter calculating step of calculating a second parameter indicating a fluctuation component between the first spectrum and the high frequency band of the second spectrum; and an encoding step of encoding the calculated first parameter and second parameter as the high-frequency-band encoding information.

Further, the scalable decoding method according to the above embodiments adopts a configuration including: a spectrum acquiring step of acquiring a first spectrum corresponding to a low frequency band; a parameter acquiring step of respectively acquiring a first parameter that is encoded as high-frequency-band encoding information and indicates a degree of similarity between the first spectrum and a high frequency band of a second spectrum corresponding to an original signal, and a second parameter that is encoded as high-frequency-band encoding information and indicates a fluctuation component between the first spectrum and the high frequency band of the second spectrum; and a decoding step of decoding the second spectrum using the acquired first parameter and second parameter.

In particular, the first scalable encoding apparatus according to the present invention estimates a high frequency band of a second spectrum using a filter having a first spectrum as an internal state, and at the spectrum encoding apparatus that encodes filter information for transmission, a spectrum residual shape codebook recorded with a plurality of spectrum residual candidates is provided, and the high frequency band of the second spectrum is estimated by providing a spectrum residual as an input signal for the filter and carrying out filtering, and it is thereby possible to encode components of the high frequency band of the second spectrum which cannot be expressed by changing the first spectrum using the spectrum residual, so that it is possible to increase estimation performance of the high frequency band of the second spectrum.

Further, the second scalable encoding apparatus according to the present invention estimates the high frequency band of the second spectrum using a filter having the first spectrum as an internal state after achieving high quality of the first spectrum by encoding an error component between the low frequency band of the second spectrum and the first spectrum, so that it is possible to achieve high picture quality through improved estimation performance by estimating the high frequency band of the second spectrum using the quality improved first spectrum after improving the quality of the first spectrum with respect to the low frequency band of the second spectrum.

Further, the third scalable encoding apparatus according to the present invention encodes an error component between the low frequency band of the second spectrum and the first spectrum so that both error components of an error component between an estimated spectrum generated by estimating the high frequency band of the second spectrum using a filter having the first spectrum as an internal state and the high frequency band of the second spectrum and an error component between the low frequency band of the second spectrum and the first spectrum become small. This means that high quality can be achieved because the first spectrum is encoded so that the quality of both the first spectrum and the estimated spectrum for the high frequency band of the second spectrum are improved at the same time when error components between the first spectrum and the low frequency band of the second spectrum are encoded.

Moreover, in the first to third scalable encoding apparatus described above, upon generation of a bitstream transmitted to the decoding apparatus at the encoding apparatus, the bitstream contains at least a scale factor, dynamic range adjustment coefficient and lag, and the bitstream is configured in this order. As a result, the configuration of the bitstream is such that parameters with a larger influence on quality are arranged closer to the MSB (Most Significant Bit) of the bitstream, it is therefore possible to obtain the effect that quality deterioration is unlikely to occur even if bits at arbitrary bit positions are eliminated from the LSB (Least Significant Bit) of the bit stream.

The present application is based on Japanese Patent Application No. 2004-322959, filed on Nov. 5, 2004, the entire content of which is expressly incorporated by reference herein.

INDUSTRIAL APPLICABILITY

The encoding apparatus, decoding apparatus, encoding method and decoding method according to the present invention can be applied to scalable encoding/decoding, and the like.

The invention claimed is:

1. An encoding apparatus that generates low-frequency-band encoding information and high-frequency-band encoding information from an original signal, the encoding apparatus comprising:

a first spectrum calculating section that calculates a first spectrum of a low frequency band from a decoded signal of the low-frequency-band encoding information;

a second spectrum calculating section that calculates a second spectrum from the original signal;

a first parameter calculating section that calculates a first parameter indicating a degree of similarity between the first spectrum and a high frequency band of the second spectrum;

a second parameter calculating section that calculates a second parameter indicating a fluctuation component between the first spectrum and the high frequency band of the second spectrum; and an encoding section that encodes the calculated first parameter and second parameter as the high-frequency-band encoding information.

2. The encoding apparatus according to claim 1, wherein the first parameter calculating section outputs a parameter indicating a characteristic of a filter as the first parameter using the filter having the first spectrum as an internal state.

3. The encoding apparatus according to claim 1, wherein the second parameter calculating section has a spectrum residual shape codebook recorded with a plurality of spectrum residual candidates and outputs a code of the spectrum residual as the second parameter.

4. The encoding apparatus according to claim 1, further comprising a residual component encoding section that encodes a residual component between the first spectrum and a low frequency band of the second spectrum, wherein the first parameter calculating section and the second parameter calculating section calculate the first parameter and the second parameter after improving quality of the first spectrum using the residual component encoded by the residual component encoding section.

5. The encoding apparatus according to claim 4, wherein the residual component encoding section improves both quality of the low frequency band of the first spectrum and quality of a high frequency band of the decoded spectrum obtained from the first parameter and the second parameter encoded by the encoding section.

6. The encoding apparatus according to claim 1, wherein:

the first parameter contains a lag;

the second parameter contains a spectrum residual; and the encoding apparatus further comprises a configuration section that configures a bitstream arranged in order of the lag and the spectrum residual.

7. An encoding apparatus that generates low-frequency-band encoding information and high-frequency-band encoding information from an original signal, the encoding apparatus comprising:

a first spectrum calculating section that calculates a first spectrum of a low frequency band from a decoded signal of the low-frequency-band encoding information;

a second spectrum calculating section that calculates a second spectrum from the original signal;

a parameter calculating section that calculates a parameter indicating a degree of similarity between the first spectrum and a high frequency band of the second spectrum;

a parameter encoding section that encodes the calculated parameter as the high-frequency-band encoding information; and a residual component encoding section that encodes a residual component between the first spectrum and a low frequency band of the second spectrum, wherein the parameter calculating section calculates the parameter after improving quality of the first spectrum using the residual component encoded by the residual component encoding section.

8. A decoding apparatus comprising:

a spectrum acquiring section that acquires a first spectrum corresponding to a low frequency band;

a parameter acquiring section that respectively acquires a first parameter that is encoded as high-frequency-band encoding information and indicates a degree of similarity between the first spectrum and a high frequency band of a second spectrum corresponding to an original signal, and a second parameter that is encoded as high-frequency-band encoding information and indicates a fluctuation component between the first spectrum and the high frequency band of the second spectrum; and a decoding section that decodes the second spectrum using the acquired first parameter and second parameter.

9. An encoding method for generating low-frequency-band encoding information and high-frequency-band encoding information from an original signal, the encoding method comprising:

a first spectrum calculating step of calculating a first spectrum of a low frequency band from a decoded signal of the low-frequency-band encoding information;

a second spectrum calculating step of calculating a second spectrum from the original signal;

a first parameter calculating step of calculating a first parameter indicating a degree of similarity between the first spectrum and a high frequency band of the second spectrum;

a second parameter calculating step of calculating a second parameter indicating a fluctuation component between the first spectrum and the high frequency band of the second spectrum; and an encoding step of encoding the calculated first parameter and second parameter as the high-frequency-band encoding information.

10. A decoding method comprising:

a spectrum acquiring step of acquiring a first spectrum corresponding to a low frequency band;

a parameter acquiring step of respectively acquiring a first parameter that is encoded as high-frequency-band encoding information and indicates a degree of similarity between the first spectrum and a high frequency band of a second spectrum corresponding to an original signal, and a second parameter that is encoded as high-frequency-band encoding information and indicates a fluctuation component between the first spectrum and the high frequency band of the second spectrum; and a decoding step of decoding the second spectrum using the acquired first parameter and second parameter.

* * * * *